US009833797B2

(12) United States Patent
Yamada et al.

(10) Patent No.: US 9,833,797 B2
(45) Date of Patent: Dec. 5, 2017

(54) ELECTROSTATIC COATING APPARATUS

(71) Applicant: ABB K.K., Tokyo (JP)

(72) Inventors: Yukio Yamada, Fujieda (JP); Takehiro Hamamura, Fujieda (JP); Shinya Nomura, Yokohama (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 14/402,870

(22) PCT Filed: May 15, 2013

(86) PCT No.: PCT/JP2013/063562
§ 371 (c)(1),
(2) Date: Nov. 21, 2014

(87) PCT Pub. No.: WO2013/183417
PCT Pub. Date: Dec. 12, 2013

(65) Prior Publication Data

US 2015/0128857 A1 May 14, 2015

(30) Foreign Application Priority Data

Jun. 6, 2012 (JP) ..... 2012-128888
Jan. 17, 2013 (JP) ..... 2013-006200

(51) Int. Cl.
*B05B 5/025* (2006.01)
*B05B 3/02* (2006.01)
(Continued)

(52) U.S. Cl.
CPC ..... *B05B 5/057* (2013.01); *B05B 5/025* (2013.01); *B05B 5/0403* (2013.01);
(Continued)

(58) Field of Classification Search
USPC ..... 118/620–640, 321, 323; 239/223, 224, 239/699–708; 427/475, 477, 485, 486
See application file for complete search history.

(56) References Cited

U.S. PATENT DOCUMENTS 5,704,554 A * 1/1998 Cooper ..... B05B 5/03 239/690.1
6,346,150 B1 * 2/2002 Conlin ..... B05B 13/0431 118/323
(Continued)

FOREIGN PATENT DOCUMENTS

WO 2007 015335 2/2007

OTHER PUBLICATIONS

U.S. Appl. No. 14/402,770, filed Nov. 21, 2014, Yamada.
(Continued)

*Primary Examiner* — Yewebdar Tadesse
(74) *Attorney, Agent, or Firm* — Oblon, McClelland, Maier & Neustadt, L.L.P.

(57) ABSTRACT

An air motor, a rotary atomizing head provided on a front side of the air motor to be rotatable by the air motor, external electrode units provided in a periphery of the rotary atomizing head, and a high-voltage applying unit that applies a high voltage to the external electrode units to indirectly charge paint particles atomized from the rotary atomizing head with the high voltage. A film cover is provided to be formed with a resin material in a film shape for covering an outer peripheral side of the air motor. The film cover includes a cylindrical rear cover that covers the rear side from the external electrode units and a cylindrical front cover that is mounted to the front side of the rear cover to cover the front side from the external electrode units.

8 Claims, 15 Drawing Sheets

(51) Int. Cl.
*B05B 5/057* (2006.01)
*B05B 5/04* (2006.01)
*B05B 15/04* (2006.01)

(52) U.S. Cl.
CPC ..... *B05B 5/0407* (2013.01); *B05B 5/0426* (2013.01); *B05B 15/045* (2013.01)

(56) References Cited

U.S. PATENT DOCUMENTS

| | | | | |
|---|---|---|---|---|
| 8,978,580 | B2 * | 3/2015 | Yamada | B05B 5/0426 118/621 |
| 2004/0255849 | A1 | 12/2004 | Giuliano et al. | |
| 2008/0121740 | A1 | 5/2008 | Yamada | |
| 2009/0032625 | A1 * | 2/2009 | Yamada | B05B 5/04 239/690 |

OTHER PUBLICATIONS

International Search Report dated Aug. 13, 2013 in PCT/JP13/063562 Filed May 15, 2013.
Chinese Office Action issued in Application No. 201380029507.3 dated Jul. 13, 2016.
European Search Report issued in Application No. 13800450.2 dated Jan. 28, 2016.

* cited by examiner

Fig.7

| | POLYVINYL CHLORIDE (PVC) | ABS RESIN | POLYAMIDE (PA) | FLUORINE RESIN (FR) | POLY-CARBONATE (PC) | POLY-PROPYLENE (PP) | A-PET |
|---|---|---|---|---|---|---|---|
| COMBUSTIBILITY | SELF-EXTINGUISHABLE | COMBUSTIBLE | FLAME RETARDANT | FLAME RETARDANT | SELF-EXTINGUISHABLE | V−0 | HB |
| BENDINGWORK TEMPERATURE ℃ | 130 | 125 | 200 | − | 160 | 160 | 100 |
| MACHINABILITY | EXCELLENT | GOOD | GOOD | | EXCELLENT | EXCELLENT | |
| ACID RESISTANCE | EXCELLENT | GOOD | BAD | EXCELLENT | GOOD | | |
| ALKALI RESISTANCE | EXCELLENT | EXCELLENT | ACCEPTABLE | EXCELLENT | BAD | EXCELLENT | EXCELLENT |
| SOLVENT RESISTANCE | SOLVENT: BAD WATER BASED: GOOD | BAD | ACCEPTABLE | EXCELLENT | BAD | GOOD | GOOD |

ELECTROSTATIC COATING APPARATUS

TECHNICAL FIELD

The present invention relates to an electrostatic coating apparatus for atomizing paint in a state of applying a high voltage thereto.

BACKGROUND ART

In general, there is known an electrostatic coating apparatus that is provided with, for example, a rotary atomizing head that is rotatably provided on the front side of an air motor by the air motor, external electrode units provided in the periphery of the rotary atomizing head, and a high voltage generator that applies a high voltage to the external electrode unit to indirectly charge paint particles atomized from the rotary atomizing head with the high voltage (Patent Document 1).

Patent Document 1 discloses the configuration in which an air motor is mounted to a housing member, and the housing member and the external electrode unit are covered with a cover made of an insulating material.

PRIOR ART DOCUMENT

Patent Document

Patent Document 1: WO 2007/015335 A1

SUMMARY OF THE INVENTION

Incidentally, in the electrostatic coating apparatus according to Patent Document 1, the cover for covering the housing member and the external electrode unit is formed as a covering member that corresponds to an outer shape of the housing member and the external electrode unit and is slightly larger than them. In this case, since the housing member and the external electrode unit are covered with the cover, adhesion of paint to the housing member or external electrode unit can be prevented. Further, adhesion of paint to the cover can also be suppressed by causing the cover to take charge with a high voltage.

However, it is difficult to completely prevent the adhesion of the paint to the cover. When any paint adheres to the cover, contamination of the cover increases around the paint that has adhered thereto. Therefore, in a coating line, the coating line is periodically stopped and it is necessary to manually clean off the paint having adhered to the cover with waste clothes, thus leading to a problem with decline in productivity.

The present invention is made in view of the foregoing problems in the conventional art, and an object of the present invention is to provide an electrostatic coating apparatus that can eliminate paint having adhered to a cover in a simple work and enhance productivity at a coating work.

(1) According to the present invention, an electrostatic coating apparatus comprises: a motor; a rotary atomizing head that is provided on the front side of the motor to be rotatable by the motor; an external electrode unit that is provided in the periphery of the rotary atomizing head; and a high-voltage applying unit that applies a high voltage to the external electrode unit to indirectly charge paint particles atomized from the rotary atomizing head with the high voltage, characterized in that: a film cover is provided to be formed with a resin material in a film shape for covering an outer peripheral side of the motor; wherein the film cover includes a cylindrical rear cover that covers the rear side from the external electrode unit and a cylindrical front cover that is mounted to the front side of the rear cover to cover the front side from the external electrode unit.

With this arrangement, there are some cases where a part of paint particles atomized from the rotary atomizing head adheres to the film cover. In this case, since the film cover includes the cylindrical rear cover that covers the rear side from the external electrode unit and the cylindrical front cover that is mounted to the front side of the rear cover to cover the front side from the external electrode unit, the film cover can be removed by separating the front cover from the rear cover even if the paint article adheres to the film cover. In replacement of it, a new front cover and rear cover or a front cover and rear cover from which the paint is already eliminated are attached to be opposed to each other in a front-rear direction, and thus the clean front and rear covers can be attached.

As a result, since the front cover and the rear cover that form the film cover can be removed/attached in a simple work, it is possible to shorten removal work hours of the paint as compared to a cleaning-off work. Thereby, since stopping hours of the coating line can be shortened, the productivity at coating work can be enhanced.

On the other hand, in a case of forming the front cover and the rear cover with, for example, a semi conductive material, it is possible to prevent intensive large electrical current from acting on these covers for a short time to suppress degradation of each cover, particularly the front cover, thus enhancing durability thereof.

(2) According to the present invention, a rear combining part is provided on the front side of the rear cover, and a front combining part is provided on the rear side of the front cover, wherein the film cover is formed to be integrated by attaching the rear combining part of the rear cover to the front combining part of the front cover.

With this arrangement, the rear cover and the front cover can be integrated by attaching the rear combining part provided on the front side of the rear cover to the front combining part provided on the rear side of the front cover. Thereby, the external electrode unit arranged in the outermost diameter side can be efficiently covered by interposing the external electrode unit between the front and rear covers.

(3) According to the present invention, the front cover is mounted to the rear cover in a state a front end part of the external electrode unit is exposed.

With this arrangement, when the front cover is mounted to the rear cover, only the front end part of the external electrode unit can be exposed to outside. Thereby, the front cover can cover the other parts except the front end part of the external electrode unit to prevent the contamination of the external electrode unit.

(4) According to the present invention, the external electrode unit includes an electrode support arm, and a needle electrode member that is provided in the electrode support arm and to which a high voltage is applied from the high-voltage applying unit, the film cover covers the electrode support arm of the external electrode unit together with the motor, and the needle electrode member of the external electrode unit is exposed from an electrode opening formed in the front cover of the film cover.

With this arrangement, since the needle electrode member of the external electrode unit is exposed from the electrode opening formed in the front cover of the film cover, ions from the needle electrode member can be securely supplied to the paint particle. Further, since the film cover covers the electrode support arm of the external electrode unit together with the motor, the contamination of the electrode support arm can be prevented.

(5) According to the present invention, the motor is supported to a housing member, the film cover covers the housing member and the external electrode unit.

With this arrangement, the film cover can prevent the paint particle from adhering to the housing member, and in addition, the film cover can be removed from the housing member by separating the front cover from the rear cover even if the paint article adheres to the film cover. Therefore, the film cover can be easily replaced to enhance the maintenance properties.

(6) According to the present invention, the rear cover is provided with a cutting part in which the rear cover is axially cut, and two separating parts that are separated by the cutting part.

With this arrangement, since the cylindrical rear cover is provided with the two separating parts that are separated by the cutting part, when the rear cover covers the external electrode unit, the motor and the like, the rear cover is deformed in a deflecting manner to separate the two separating parts from each other. Thereby, the rear cover can be mounted to surround the external electrode unit by widening the cutting part. As a result, also in a state where the coating apparatus is mounted to a robot or the like, the rear cover can be easily mounted.

(7) According to the present invention, the two separating parts are removably coupled by a coupling member. Thereby, since the two separating parts are coupled by the coupling member, the separating parts pull away from each other by releasing the coupling by the coupling member, thus making it possible to remove the rear cover. On the other hand, the rear cover is fixed to the front cover in a state of being mounted to the front cover by coupling the two separating parts with the coupling member. Therefore, the rear cover can be easily replaced to enhance the maintenance properties.

(8) According to the present invention, a shaping air ring is provided on the rear side of the rotary atomizing head, the shaping air ring being provided with an air spout hole formed to spout shaping air and being connected to ground, and the front cover is formed by a semi conductive member and is connected to the shaping air ring.

With this arrangement, since the shaping air ring is grounded to the earth electrical potential, it is not necessary to provide another member only for grounding the front cover. In addition, since the discharge is generated also in the periphery of the grounded shaping air ring, ions can be supplied to the periphery of the air spout hole to accelerate the charging of the paint particles through the shaping air.

On the other hand, the corona ions by the corona discharge are generated in the vicinity of the external electrode unit to form a minus ionization zone by the corona ions. Therefore, the paint particles atomized from the rotary atomizing head pass through the ionization zone to be charged with the minus high-voltage and to be charged paint particles.

In this case, ions from the external electrode unit tend to easily concentrate on the grounded front cover. However, since the front cover is a resistive element that is formed of a resin material and has higher volume resistivity and higher surface resistivity as compared to a metallic material, an electrical potential gradient is formed in the front cover. That is, the part in contact with the shaping air ring of the front cover becomes in a state where an electrical potential thereof is low, and parts except it become in a state where the electrical potential is high. At this time, since the front cover is charged with same polarity as that of the charged paint particles, the charged paint particle is more difficult to adhere thereto as compared to the shaping air ring, making it possible to suppress the contamination of the front cover.

Further, when the front cover takes charge, there is a possibility that discharge is generated between the charged front cover and the grounded shaping air ring. At this time, since the front cover is formed by the semi conductive material, even if the electrical current by discharge flows in the front cover, the electrical current does not become intensive large electrical current for a short time, but slow electrical current. As a result, degradation of the front cover can be suppressed to enhance the durability.

BRIEF DESCRIPTION OF THE DRAWINGS

FIG. 7 is an explanatory diagram showing characteristics of various kinds of resin materials.

MODE FOR CARRYING OUT THE INVENTION

Hereinafter, an electrostatic coating apparatus according to an embodiment of the present invention will be in detail explained with reference to the accompanying drawings by taking a rotary atomizing head type coating apparatus as an example.

FIG. 1 to FIG. 7 show a first embodiment of an electrostatic coating apparatus in the present invention.

Figure 1:
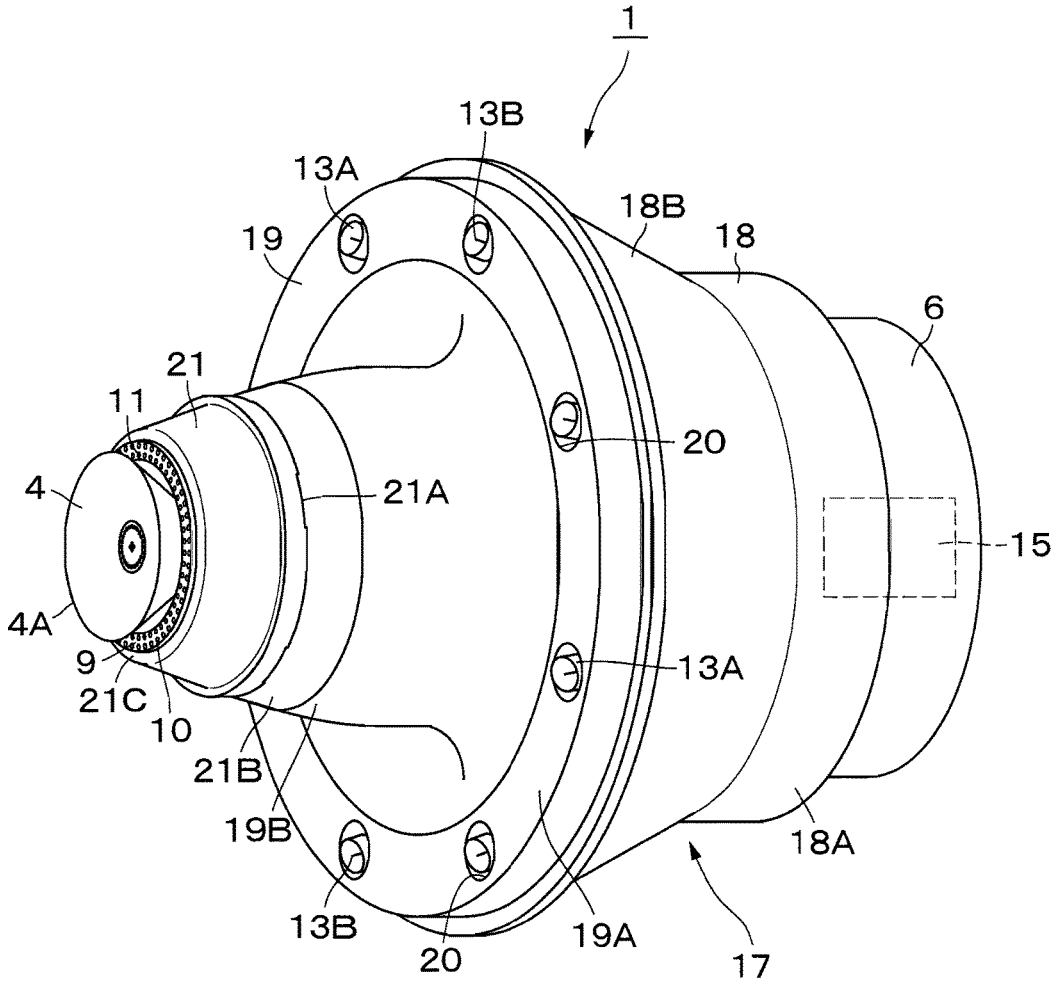
FIG. 1 is a perspective view showing a rotary atomizing head type coating apparatus according to a first embodiment in the present invention.
Figure 2:
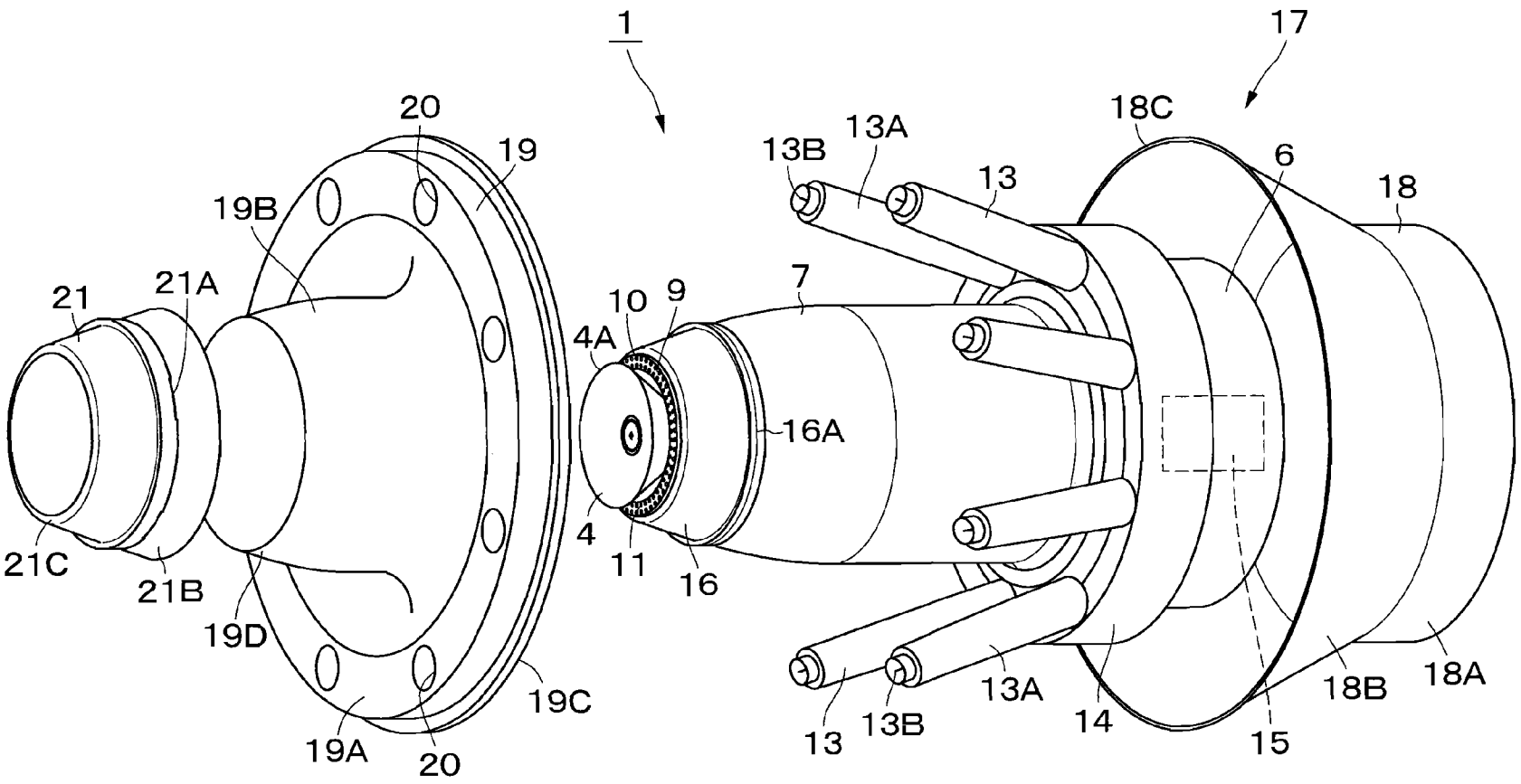
FIG. 2 is an exploded perspective view showing a state where a rear cover, a front cover and a semi conductive member in the rotary atomizing head type coating apparatus in FIG. 1 are exploded.
Figure 3:
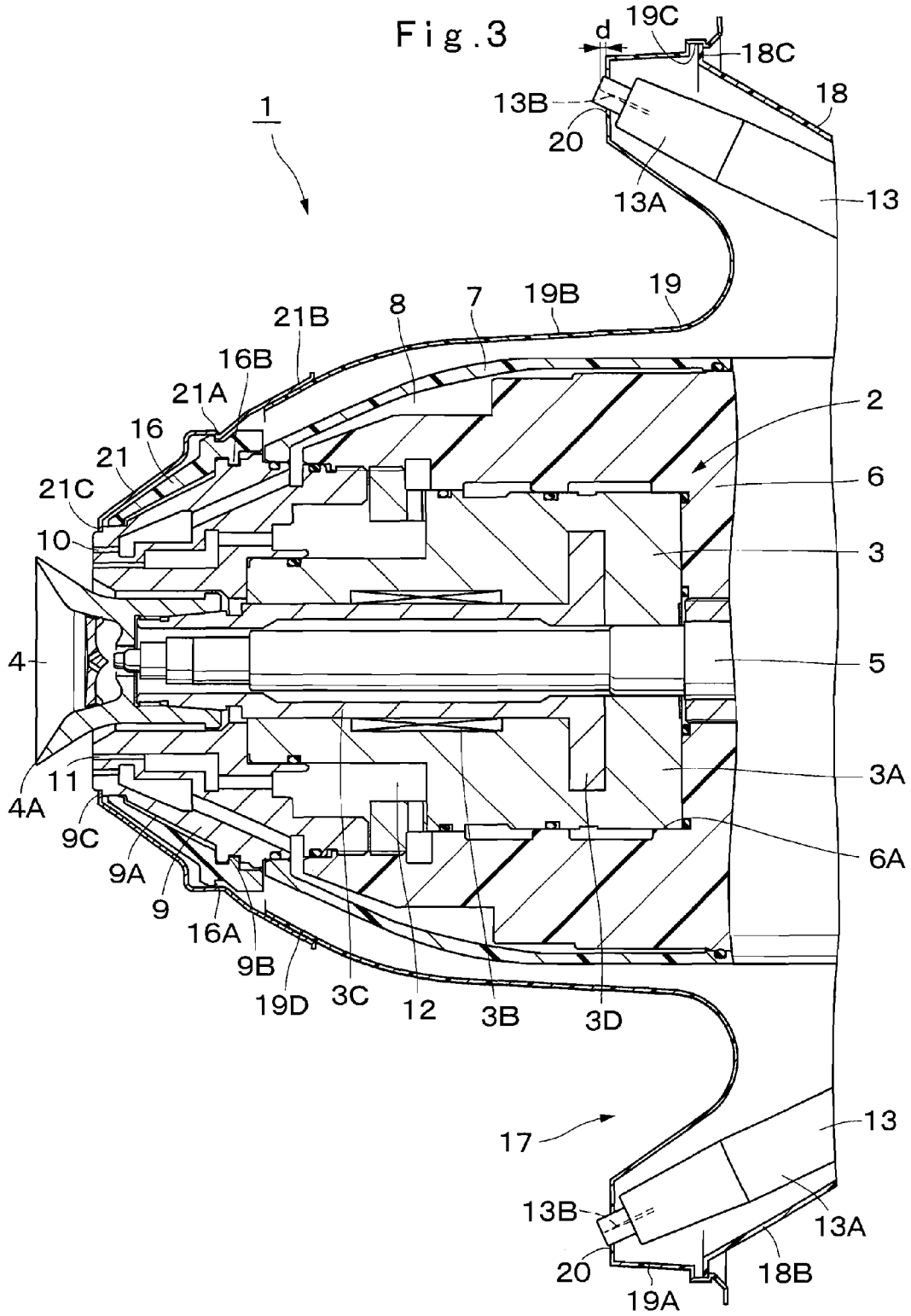
FIG. 3 is a cross section showing the rotary atomizing head type coating apparatus in FIG. 1.

In the figure, designated at 1 is a rotary atomizing head type coating apparatus (hereinafter, referred to as coating apparatus 1) according to the first embodiment. As shown in FIG. 2 and FIG. 3, the coating apparatus 1 includes an atomizer 2, a housing member 6, a shaping air ring 9, external electrode units 13, a high voltage generator 15, a film cover 17, and a semi conductive member 21, which will be described later.

Indicated at 2 is the atomizer that atomizes paint toward an object to be coated (not shown) having an earth potential. The atomizer 2 includes an air motor 3 and a rotary atomizing head 4, which will be described later.

The air motor 3 drives the rotary atomizing head 4 for rotation, and the air motor 3 is made of a conductive metallic material such as an aluminum alloy, and is connected to ground. As shown in FIG. 3, the air motor 3 includes a motor housing 3A, a hollow rotary shaft 3C rotatably supported in the motor housing 3A through a static pressure air bearing 3B, and an air turbine 3D fixed to a base end side of the rotary shaft 3C. The air motor 3 supplies drive air to the air turbine 3D to rotate the rotary shaft 3C and the rotary atomizing head 4 in a high speed of, such as 3000 to 150000 rpm.

The rotary atomizing head 4 is rotatably provided on the front side of the air motor 3. That is, the rotary atomizing head 4 is mounted to a front end side of the rotary shaft 3C of the air motor 3. The rotary atomizing head 4 is formed of a conductive metallic material such as an aluminum alloy, and is connected to ground through the air motor 3. The rotary atomizing head 4 is provided with a paint releasing edge 4A formed therein to be positioned in a front end part of the outer peripheral side for releasing paint. Therefore, in a state where the rotary atomizing head 4 is rotated in a high speed by the air motor 3, when the paint is supplied to the rotary atomizing head 4 through a feed tube 5 to be described later, the rotary atomizing head 4 atomizes the paint from the paint releasing edge 4A by a centrifugal force.

The feed tube 5 is provided to be inserted in the rotary shaft 3C, and a front end side of the feed tube 5 projects from a front end of the rotary shaft 3C and extends into the rotary atomizing head 4. A paint passage (not shown) is provided in the feed tube 5, and the paint passage is connected to a paint supply source and a washing fluid supply source (none of them are shown) through a color change valve device and the like. Thereby, the feed tube 5 supplies paint from the paint supply source through the paint passage to the rotary atomizing head 4 at coating. On the other hand, the feed tube 5 supplies washing fluids (thinner, air or the like) from a washing fluid supply source toward the rotary atomizing head 4 at washing or color changing.

The housing member 6 accommodates the air motor 3 therein, and the rotary atomizing head 4 is arranged on a front end side thereof. The housing member 6 is formed in a substantially columnar shape by, for example, an insulating resin material. A motor accommodating hole 6A accommodating the air motor 3 is formed on the front side of the housing member 6. The motor housing 3A is mounted in the motor accommodating hole 6A, and thereby the air motor 3 is supported to the housing member 6.

The air passage member 7 is provided to cover an outer peripheral surface in a front side part of the housing member 6. The air passage member 7 is formed in a cylindrical shape using, for example, an insulating resin material similar to that of the housing member 6. A first air passage 8 is formed between the air passage member 7 and the housing member 6 to supply first shaping air.

Indicated at 9 is the shaping air ring that spouts shaping air toward the outer peripheral surface of the rotary atomizing head 4. The shaping air ring 9 is provided on a front end side of the housing member 6 to be positioned backward of the rotary atomizing head 4. The shaping air ring 9 is formed in a cylindrical shape by, for example, a conductive metallic material, and is connected to ground through the air motor 3. As a result, the shaping air ring 9 forms an earth member according to the present invention. It should be noted that the shaping air ring 9 may be directly connected to ground or indirectly connected to ground though a resistance.

Figure 4:
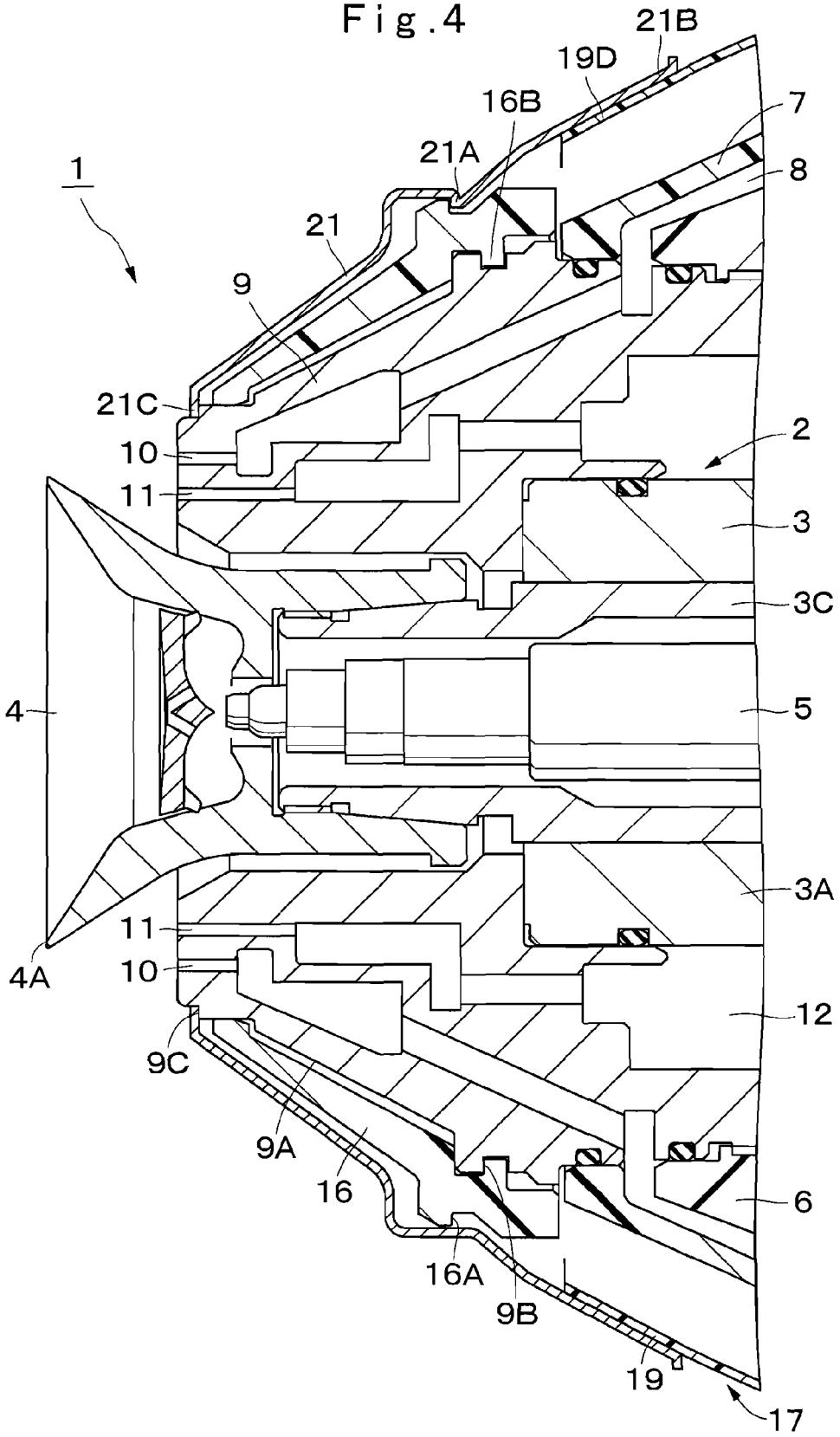
FIG. 4 is a partially enlarged cross section showing the periphery of a shaping air ring and a semi conductive member in FIG. 3 in an enlarging manner.
Figure 5:
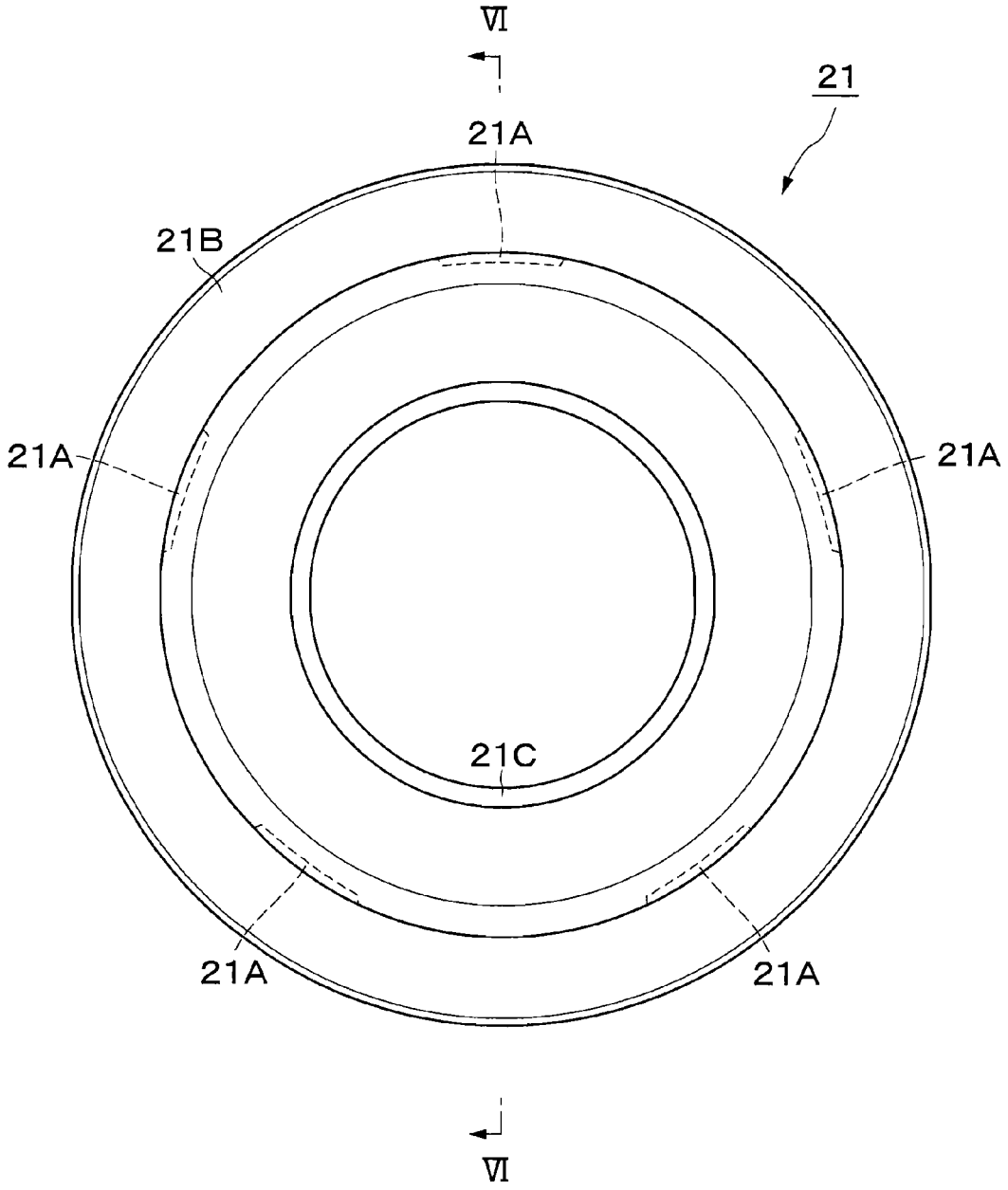
FIG. 5 is a front view showing the semi conductive member to be enlarged from the front side.
Figure 6:
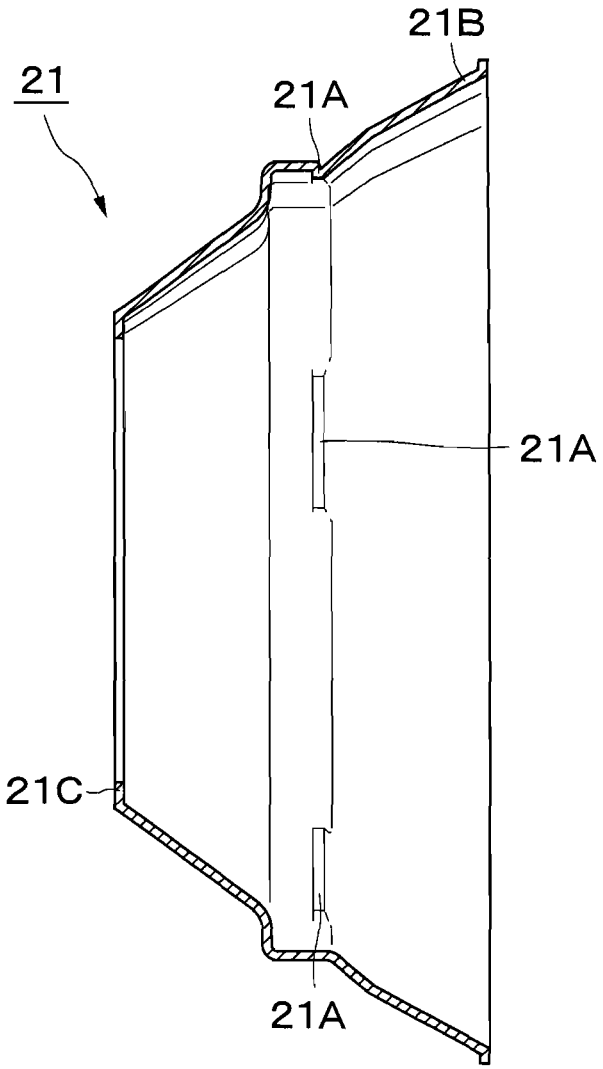
FIG. 6 is a cross section showing the semi conductive member as viewed in a direction of arrows VI-VI in FIG. 5.

As shown in FIG. 4, a plurality of groove parts 9B are formed on the outer peripheral surface 9A of the shaping air ring 9 to mount an adaptor 16 thereto. The plurality of groove parts 9B are arranged to be spaced by equal intervals in the circumferential direction. A stepped part 9C is formed on a front end part of the shaping air ring 9 by protruding a radial inside part thereof to the forward side.

The shaping air ring 9 is provided with first air spout holes 10 and second air spout holes 11 formed therein. The first air spout holes 10 are arranged closer to a radial inside part (front side projecting part) than the stepped part 9C of the shaping air ring 9 and are provided along a paint releasing edge 4A of the rotary atomizing head 4. These first air spout holes 10 are arranged to line up annularly. Each of the first air spout holes 10 is communicated with the first air passage 8 provided between the housing member 6 and the air passage member 7. The first shaping air is supplied to each of the first air spout holes 10 through the air passage 8, and the air spout hole 10 spouts the first shaping air to the vicinity of the paint releasing edge 4A of the rotary atomizing head 4.

The second air spout holes 11 are formed in the shaping air ring 9 together with the first air spout holes 10. The second air spout holes 11 are respectively arranged closer to a radial inside than the first air spout holes 10 and are arranged to line up annularly. Each of the second air spout holes 11 is communicated with a second air passage 12 provided in the housing member 6. Thereby, the second shaping air having the same pressure as or a pressure different from the shaping air is supplied to the second air spout holes 11 through the air passage 12, and the second air spout hole 11 spouts the second shaping air to the back surface of the rotary atomizing head 4.

Thereby, the first and second shaping air shears liquid thread of paint released from the rotary atomizing head 4 to accelerate formation of paint particles, and shapes an atomizing pattern of paint particles atomized from the rotary atomizing head 4. At this time, the pressure of the first shaping air and the pressure of the second shaping air are adjusted as needed, thus making it possible to change the atomizing pattern to a desired size or shape.

Indicated at 13 are the external electrode units that are provided on the outer peripheral side of the housing member 6. As shown in FIG. 2, the external electrode units 13 are mounted to a collar-shaped support member 14 arranged on the rear side of the housing member 6. The support member 14 is formed by, for example, an insulating resin material as similar to that of the housing member 6, and projects to a radial outside from the housing member 6. For example, eight external electrode units 13 are provided to be spaced by equal intervals in the circumferential direction to be positioned in a projecting end side (outer diameter side) of the support member 14. These eight external electrode units 13 are annularly arranged coaxially with the rotary atomizing head 4, and are arranged along a circle around the rotary shaft 3C. It should be noted that not only the eight external electrode units 13 but also nine or more or seven or less external electrode units 13 may be adopted.

Here, the external electrode unit 13 includes an electrode support arm 13A extending in a long, bar-shape to the front side from the support member 14 and a needle electrode member 13B provided in a front end of the electrode support arm 13A. The electrode support arm 13A is formed using an insulating resin material as similar to, for example, the housing member 6 or support member 14, and its front end is arranged in a backward outer peripheral side of the rotary atomizing head 4 on the periphery of the rotary atomizing head 4. On the other hand, the needle electrode member 13B is formed in a needle shape using a conductive material such as metal to have a front end thereof as a free end, and is arranged in a shallow accommodation recessed part provided in a front end of the electrode support arm 13A. The needle electrode member 13B is connected to a high voltage generator 15 to be described later through a resistance (not shown) provided in the electrode support arm 13A.

The eight needle electrode members 13B are annually arranged coaxially with the rotary atomizing head 4, and are provided in a position along a large diameter circle having a large diameter dimension around the rotational shaft 13C. The eight needle electrode members 13B are arranged on the rear side of the atomizer 2 than the shaping air ring 9. Therefore, the external electrode units 13 charge paint particles atomized from the rotary atomizing head 4 with a minus high voltage by generation of corona discharge from the needle electrode members 13B.

Designated 15 is a high voltage generator as a high voltage applying unit that is connected to the external electrode unit 13. The high voltage generator 15 is formed by, for example, a multiple stepped rectification circuit (what is called cock croft circuit), and is connected electrically to each needle electrode member 13B of the external electrode units 13. In addition, the high voltage generator 15 generates a high voltage of a direct current voltage of −10 kV to −150 kV, for example, and supplies this high voltage to each needle electrode member 13B of the external electrode units 13.

The adaptor 16 is provided in the shaping air ring 9, and the adaptor 16 is formed by an insulating material or semi conductive material. Specifically, the adaptor 16 is formed in a ring shape, and is mounted to the shaping air ring 9 to cover the outer peripheral surface 9A of the shaping air ring 9. A ring-shaped engaging groove part 16A is formed on an outer peripheral side of the adaptor 16 over an entire periphery for mounting the semi conductive member 21 to be described later.

Further, a plurality of projections 16B projecting toward a radial inside are provided on an inner peripheral side of the adaptor 16 in positions corresponding to the groove parts 9B of the shaping air ring 9. The plurality of projections 16B are arranged to be spaced by equal intervals in the circumferential direction.

When the adaptor 16 is mounted to the shaping air ring 9, the adaptor 16 is pushed into the outer peripheral side of the shaping air ring 9 from forward to backward, and the adaptor 16 is rotated by a predetermined angle in the circumferential direction in this state. Therefore, the projection 16B of the adaptor 16 is inserted in the groove part 9B of the shaping air ring 9 to cause both to be engaged with each other, thus mounting the adaptor 16 to the shaping air ring 9. The adaptor 16 can be removed from the shaping air ring 9 by the reverse operation to the above.

It should be noted that the adaptor 16 can be mounted to or removed from the shaping air ring 9 by an engaging mechanism composed of the projections 16B and the groove parts 9B. However, the present invention is not limited thereto, and the engaging mechanism may be configured such that a female screw is formed on an inner peripheral side of the adaptor 16 and a male screw is formed on an outer peripheral side of the shaping air ring 9 to screw the adaptor 16 and the shaping air ring 9 with each other for fixation. Further, if it is not necessary to remove the adaptor 16, the adaptor 16 may be fixed to the shaping air ring 9.

Designated at 17 is the film cover that is formed of a resin material in a film shape for covering the outer peripheral side of the air motor 3. The film cover 17 is formed in a thin film shape using an insulating resin material, such as polypropylene (PP), polyethylene terephthalate (PET) or polyethylene (PE). The film cover 17 is formed by a resin film having a thickness dimension of 2 mm or less, preferably about 0.1 mm to 1.5 mm. For reducing the material cost, preferably the thickness dimension of the film cover 17 is as thin as possible within a range where a mechanical strength of the film cover 17 can be secured.

A material of the film cover 17 has flame retardation and self-extinguishing properties, and is selected as needed in consideration of workability and solvent resistance. Considering a case of vacuum-molding the film cover 17, when water-based paint is used, it is preferable to use, for example, polyvinyl chloride (PVC), and when solvent-based paint is used, it is preferable to form the film cover 17 with a material excellent in solvent resistance, such as polypropylene (PP).

Various kinds of resin materials containing these insulating resin materials have characteristics as shown in an explanatory diagram of FIG. 7, and a material suitable for certain conditions can be applied to the film cover 17. Also, any material, which is suitable for the film cover 17, can be applied other than the resin materials described in the explanatory diagram in FIG. 7.

In a case of ejection molding or extrusion molding, the film cover 17 can be formed with polyvinyl chloride (PVC), polycarbonate (PC), fluorine resin materials (PTFE: polytetrafluoroethylene, ETFE: tetrafluoroethylene/ethylene copolymer, FEP: tetrafluoroethylene/hexafluoropropylene copolymer or the like) or polyphenylene sulfide (PPS), having self-extinguishing properties. In a case of ejection molding or extrusion molding, a flame retardation resin material formed by adding an additive to a thermoplastic resin material or a thermosetting resin material can be used. The thermoplastic resin material may include, for example, acrylonitrile-butadiene-styrene copolymer (ABS), polystyrene (PS), polypropylene (PP), polyethylene (PE), ABS/PC aroyl, polybutyleneterephthalate (PBT), variant polyphenylene ether (m-PPE), polyamide (PA), or polycarbonate (PC). The thermosetting resin material may include, for example, an epoxy resin material or phenol resin material.

Here, the film cover 17 includes a cylindrical rear cover 18 mounted to the housing member 6 to cover the rear side from the external electrode unit 13 and a cylindrical front cover 19 mounted to the front side of the rear cover 18 to cover the front side from the external electrode unit 13, that is, the air motor 3. That is, the film cover 17 is integrated by attaching the front side of the rear cover 18 to the rear side of the front cover 19.

The rear cover 18 is provided with a fixing part 18A that is formed in a cylindrical shape and is fixed to the housing member 6 and a flared part 18B that extends to flare in a bell shape forward from a front end of the fixing part 18A. The fixing part 18A is mounted on an outer peripheral side of the support member 14 using a fixing means (not shown) such as a bolt or lock pin and is fixed to the housing member 6. At this time, the flared part 18B covers a radial outside of the external electrode unit 13, and eight electrode support arms 13A are arranged inside the flared part 18B. Further a flange part 18C as a rear combining part that spreads radially outward is provided in a front side opening end of the flared part 18B.

The front cover 19 is provided with a disc part 19A that is positioned in a rear part outer peripheral side and is formed in a disc shape and a cylindrical part 19B that is successively formed to an inner peripheral edge of the disc part 19A to extend forward. The disc part 19A covers a front end part of each of the electrode support arms 13A forming the external electrode units 13 from a radial outside. The disc part 19A is provided with electrode openings 20 formed in positions corresponding to the front end parts of the respective electrode support arms 13A to expose the front end parts of the electrode support arms 13A. The needle electrode member 13B of the external electrode unit 13 is exposed to the front side from the electrode opening 20. As shown in FIG. 3, preferably the front end of the needle electrode member 13B projects having a projection dimension d of about 1 mm to 10 mm from the electrode opening 20, for example.

An annular combining groove part 19C as a front combining part is formed on a rear side opening end of the disc part 19A to extend over the entire circumference to be positioned on the inner peripheral side. The flange part 18C of the rear cover 18 is inserted and fitted in the combining groove part 19C. As a result, the front cover 19 is pushed against the front side of the rear cover 18 to be attached in an outer peripheral side position of the external electrode units 13. In this way, the front cover 19 and the rear cover 18 are attached to be positioned closer to the radial outside than the external electrode unit 13. Therefore, in a state where the front cover 19 is attached to the rear cover 18, the external electrode units 13 can be accommodated to be interposed between the disc part 19A and the flared part 18B. On the other hand, the flange part 18C of the rear cover 18 is flexibly deformed by pulling the front cover 19 forward, thus making it possible to separate the flange part 18C from the combining groove part 19C. Thereby, the front cover 19 can be removed from the rear cover 18.

The cylindrical part 19B covers the outer peripheral side of the air motor 3 including the housing member 6 and the air passage member 7. A front end part 19D of the cylindrical part 19B is arranged near the rear end of the shaping air ring 9 to be positioned to be radially spaced from the shaping air ring 9. That is, the film cover 17 is not in contact with the shaping air ring 9, and a radial or axial gap is formed between the film cover 17 and the shaping air ring 9.

Designated at 21 is the semi conductive member formed of a semi conductive material. The semi conductive member 21 is formed of a semi conductive resin material having a surface resistance of $10^{10}$ to $10^{7}$ Ωm or volume resistance of $10^{8}$ to $10^{5}$ Ωm, for example. Specifically, the semi conductive member 21 is formed using a semi conductive resin sheet in which a semi conductive resin is kneaded in amorphous-polyethylene terephthalate (A-PET), a three-layered resin film in which a polystyrene semi conductive film is interposed between two polypropylene (PP) films or the like. The semi conductive member 21 may be formed by a resin material having semi conductivity by blending a conductive element with the same material as that of the film cover 17, for example. The semi conductive member 21 has a thickness dimension of, for example, 2 mm or less, preferably about 0.1 mm to 1.5 mm, and flares from forward to backward to be formed in a substantially conical shape or in a substantially cylindrical shape.

A plurality (for example, five) of engaging projections 21A are formed in the intermediate position of the semi conductive member 21 in the front-rear direction to project toward a radial inside. The plurality of engaging projections 21A extend in an arc shape along the engaging groove parts 16A of the adaptor 16 in the circumferential direction, and are arranged to be spaced by equal intervals from each other in the circumferential direction. When the semi conductive member 21 is pushed against the adaptor 16 from forward to backward, the plurality of engaging projections 21A are inserted in the engaging groove part 16A of the adaptor 16. Thereby, the semi conductive member 21 is mounted to the outer peripheral side of the adaptor 16. When the semi conductive member 21 is pulled forward, the engaging projection 21A is flexibly deformed to pull the engaging projection 21A out of the engaging groove part 16A. Thereby, the semi conductive member 21 can be removed from the adaptor 16.

A rear end part 21B that is one end part of the semi conductive member 21 is in contact with the front end part 19D of the front cover 19. Specifically, the rear end part 21B of the semi conductive member 21 covers the front end part 19D of the front cover 19 from outside to be in surface contact with the front end part 19D, and the semi conductive member 21 can be conductive to the front cover 19.

On the other hand, a front end part 21C that is the other end part of the semi conductive member 21 is in contact with the shaping air ring 9. Specifically, the front end part 21C of the semi conductive member 21 is formed as a ring-shaped flat plate extending radially inside, is in surface contact with an end surface of the stepped part 9C provided on a front outer peripheral side of the shaping air ring 9, and the semi conductive member 21 can be conductive to the shaping air ring 9.

It should be noted that the rear end part 21B of the semi conductive member 21 is in surface contact with the front end part 19D of the front cover 19, and the front end part 21C of the semi conductive member 21 is in surface contact with the stepped part 9C of the shaping air ring 9. However, the present invention is not limited thereto, and only if the rear end part 21B of the semi conductive member 21 and the front end part 19D of the front cover 19 are electrically connected to each other, they may be in line contact or in point contact. Similarly, the front end part 21C of the semi conductive member 21 may be in line contact or point contact with the stepped part 9C of the shaping air ring 9. For increasing an electrical resistance of the semi conductive member 21 between the shaping air ring 9 and the front cover 19, the front end and the rear end of the semi conductive member 21 is preferably in line contact or point contact with each other. On the other hand, for securing the electrical connection, the semi conductive member 21 is preferably in surface contact with the shaping air ring 9 or the front cover 19.

The coating apparatus 1 according to the first embodiment has the aforementioned configuration, and next an explanation will be made of an operation at the time of performing a coating work using the coating apparatus 1.

First, the rotary atomizing head 4 is rotated at a high speed by the air motor 3, and the paint is supplied to the rotary atomizing head 4 through the feed tube 5 at this state. Therefore, the atomizer 2 micro-particulates the paint by a centrifugal force when the rotary atomizing head 4 rotates, and atomizes the paint as the paint particles. At this time, the first and second shaping air is supplied from the first and second air spout holes 10, 11 provided in the shaping air ring 9, and the shaping air controls an atomizing pattern composed of the paint particles.

Here, a minus high voltage is applied to the needle electrode member 13B of the external electrode unit 13 by the high voltage generator 15. Therefore, an electrostatic field is regularly formed between the needle electrode member 13B and the object to be coated having the earth potential. Therefore, corona discharge is generated in the front end of the needle electrode member 13B to generate the ionization zone caused by the corona discharge in the periphery of the rotary atomizing head 4. As a result, the paint particles atomized from the rotary atomizing head 4 pass through the ionization zone, and thereby are indirectly charged with a high voltage. The paint particles charged with the high voltage (charged paint particles) fly along the electrostatic field formed between the needle electrode member 13B and the object to be coated and adhere to the object to be coated for paint.

Next, an explanation will be made of effects of suppressing degradation, contamination or the like of the film cover 17 by the semi conductive member 21.

Here, a description will be made of a case of omitting the semi conductive member 21, for example. In this case, a surface of the film cover 17 made of the insulating material collides with ions from the external electrode unit 13 for charge to increase the electrical potential. At this time, when a difference in electrical potential between the charged film cover 17 and the grounded shaping air ring 9 increases and thus the insulating state cannot be maintained, the discharge is generated. Several micro seconds of pulse discharge is generated in air to release energy accumulated by the charging in a short time.

Thereby, ozone is generated by plasma, collision of electrons by the discharging, local heat generation of joule by electrical current, and by release of electromagnetic wave by transition from energized state to base state, and the like, oxidation or reduction of molecular weight is generated in peripheral materials such as the film cover 17 and the peripheral materials are degraded. Particularly, since the shaping air ring 9 or rotary atomizing head 4 has the fixed electrical potential and an electrical line of force is pulled therein from the external electrode unit 13, ion particles concentrate thereon. As a result, the front end part 19D of the film cover 17 near the shaping air ring 9 or the rotary atomizing head 4 is more easily charged than other parts and is remarkable in degradation progress.

In contrast to this, in the first embodiment, the boundary between the front end part 19D of the film cover 17 made of an insulating material and the shaping air ring 9 made of a conductive material is covered with the semi conductive member 21, and the rear end part 21B of the semi conductive member 21 is made in contact with the front end part 19D of the film cover 17 and at the same time the front end part 21C of the semi conductive member 21 is made in contact with the stepped part 9C of the shaping air ring 9, while the semi conductive member 21 is connected to ground.

In this case, the electric charge charged to the film cover 17 is discharged to the semi conductive member 21, but the electrical current does not become intensively large for a short time, as in the case of discharge to the shaping air ring 9 made of the conductive material, and becomes slow electrical current. Therefore, degradation of the film cover 17 is suppressed. On the other hand, the electrical current flows also in the semi conductive member 21 following the discharge from the film cover 17, but this electrical current becomes several ten μA or less. Therefore, there is no possibility that the semi conductive member 21 itself may be eventually degraded due to supply of the electrical current thereto.

Further, since the shaping air ring 9 has an earth potential, ions from the external electrode unit 13 tend to easily concentrate on the semi conductive member 21 in contact with the shaping air ring 9. However, since the semi conductive member 21 is a resistance having a higher volume resistance or a higher surface resistance as compared to that of a metallic material, an electrical potential gradient is formed in the semi conductive member 21, an electrical potential of which becomes in a higher state as compared to that of the shaping air ring 9. At this time, since the semi conductive member 21 takes charge with the same polarity as the charged paint particle, the charged paint particle becomes difficult to adhere thereto as compared to the shaping air ring 9, making it possible to suppress the contamination.

Thus, according to the first embodiment, the film cover 17 made of an insulating resin material includes the cylindrical rear cover 18 that covers the rear side from the external electrode unit 13 and the cylindrical front cover 19 that is mounted to the front side of the rear cover 18 to cover the front side from the external electrode unit 13. Therefore, the film cover 17 can be removed by separating the rear cover 18 from the front cover 19 even if the paint article adheres to the film cover 17. In replacement of it, the new rear cover 18 and front cover 19 or the rear cover 18 and front cover 19 which the paint is already removed are attached to be opposed to each other in a front-rear direction, and thereby the clean rear cover 18 and front cover 19 can be integrated.

As a result, since the rear cover 18 and the front cover 19 that form the film cover 17 can be attached/separated in a simple work, it is possible to shorten removal work hours of the paint as compared to a cleaning-off work. Thereby, since stopping hours of the coating line can be shortened, the productivity at coating work can be enhanced.

The flange part 18C is provided on the front side of the rear cover 18, and the combining groove part 19C is provided on the rear side of the front cover 19, wherein the flange part 18C of the rear cover 18 and the combining groove part 19C of the front cover 19 are attached to be positioned closer to the radial outside than the external electrode unit 13, so that the flange part 18C and the combining groove part 19C can be integrated. Therefore, the flange part 18C can be fitted in the combining groove part 19C by pushing the front cover 19 on the front side of the rear cover 18 to simply attach the front cover 19 to the rear cover 18. On the other hand, the flange part 18C of the rear cover 18 can be flexibly deformed by pulling the front cover 19 forward to be pulled out of the combining groove part 19C of the front cover 19, so that the front cover 19 can be simply removed from the rear cover 18. Here, in a state where the rear cover 18 and the front cover 19 are attached, the external electrode units 13 arranged on the outermost diameter side (outermost periphery of the coating apparatus 1) are interposed by the front and rear covers 19, 18, thereby effectively covering the external electrode units 13.

On the other hand, the rear end part 21B of the semi conductive member 21 is made in electrical contact with the film cover 17 and the front end part 21C of the semi conductive member 21 is made in electrical contact with the shaping air ring 9. Therefore, the discharge between the film cover 17 and the shaping air ring 9 is prevented by the semi conductive member 21 to suppress degradation of the film cover 17, thus making it possible to enhance the durability. In addition thereto, since the semi conductive member 21 takes charge with the same polarity as the charged paint particle, the adhesion of the charged paint particle can be suppressed.

In this way, since the shaping air ring 9 is connected to ground, it is not necessary to provide another member only for grounding the front end part 21C of the semi conductive member 21. Further, since the discharge is generated also in the periphery of the grounded shaping air ring 9, ions can be supplied in the periphery of the air spout holes 10, 11 to accelerate charge of paint particles through the shaping air.

The adaptor 16 made of an insulating material or semi conductive material is provided in the shaping air ring 9. Thereby, even when the front end part 19D of the film cover 17 is arranged in the periphery of the shaping air ring 9, insulation properties between the film cover 17 and the shaping air ring 9 can be enhanced to suppress direct discharge therebetween.

On the other hand, since the front end part 21C of the semi conductive member 21 is in electrical contact with the shaping air ring 9, the semi conductive member 21 has the electrical potential closer to earth than the film cover 17, and paint particles tend to easily adhere thereto. However, since the semi conductive member 21 is replaceably mounted to the adaptor 16, only the semi conductive member 21 that tends to be easily contaminated can be replaced to enhance the maintenance properties.

Since the needle electrode member 13B of the external electrode unit 13 is exposed outside from the electrode opening 20 formed in the front cover 19 of the film cover 17, ions from the needle electrode member 13B can be supplied to the paint particles. Since the film cover 17 covers the electrode support arm 13A of the external electrode unit 13 in addition to the air motor 3, the film cover 17 can prevent the contamination of the electrode support arm 13A and keep it clean.

Further, the film cover 17 is configured of the rear cover 18 mounted to the housing member 6 and the front cover 19 attached on the front side of the rear cover 18 to cover the air motor 3. Thereby, even if the paint particle adheres to the film cover 17, the film cover 17 can be removed from the housing member 6 by separating the front cover 19 from the rear cover 18. Therefore, the film cover 17 can be easily replaced to enhance the maintenance properties.

Figure 8:
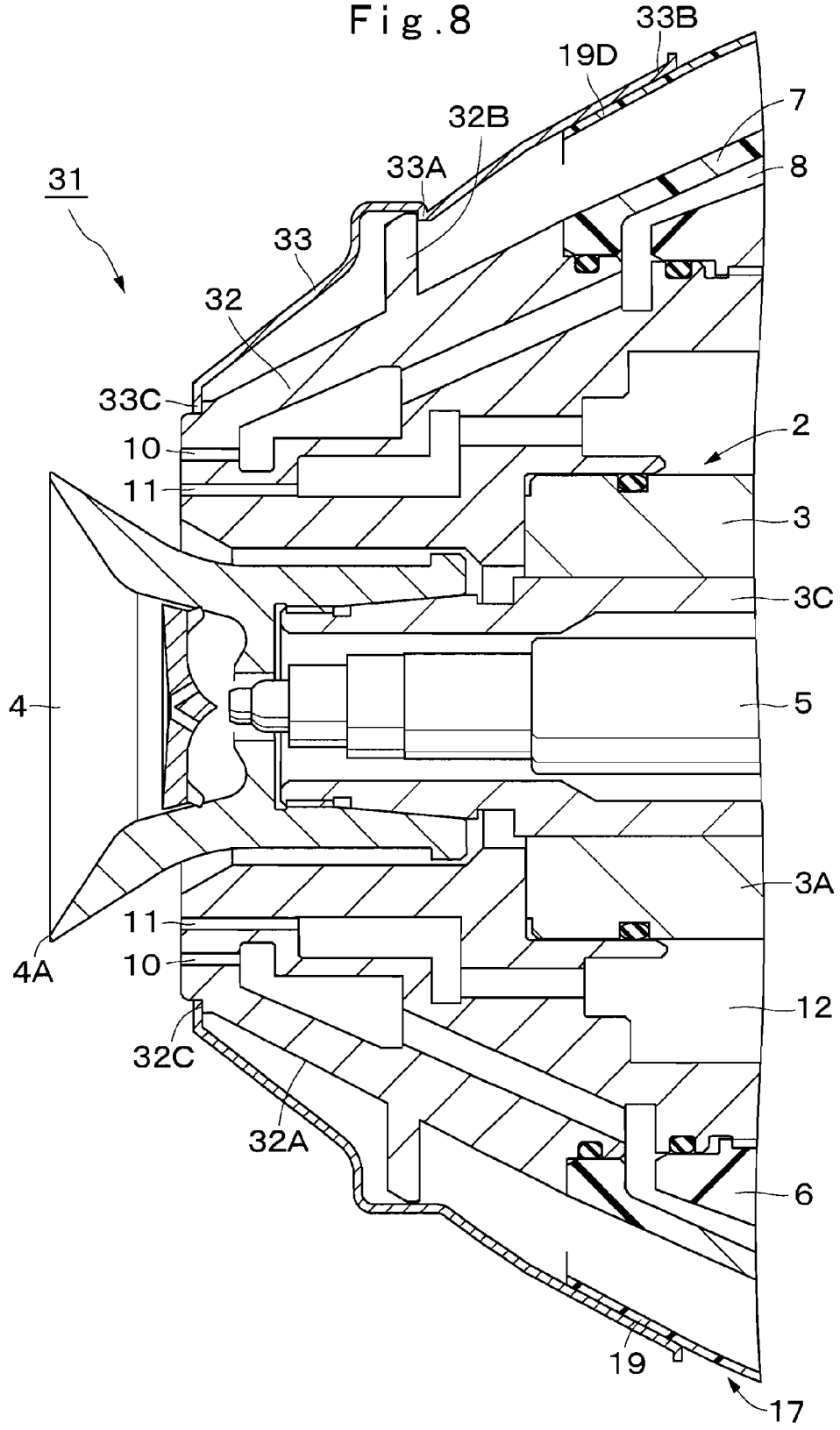
FIG. 8 is a partially enlarged cross section showing a rotary atomizing head type coating apparatus according to a second embodiment in the present invention in a position similar to that of FIG. 4.

Next, FIG. 8 shows a second embodiment of an electrostatic coating apparatus according to the present invention. The second embodiment is characterized in that a shaping air ring is provided with an inside engaging part, and an outside engaging part engaging with the inside engaging part is provided in the midway part between one end part and the other end part of a semi conductive member. In the second embodiment, the component elements that are identical to those of the foregoing first embodiment will be simply denoted by the same reference numerals to avoid repetitions of similar explanations.

Designated at 31 is a rotary atomizing head type coating apparatus (hereinafter, referred to as coating apparatus 31) according to the second embodiment. The coating apparatus 31 includes, as substantially similar to the coating apparatus 1 according to the first embodiment, an atomizer 2, a housing member 6, a shaping air ring 32, external electrode units 13, a high voltage generator 15, a film cover 17, a semi conductive member 33 and the like.

Indicated at 32 is the shaping air ring according to the second embodiment. The shaping air ring 32 is formed as substantially similar to the shaping air ring 9 according to the first embodiment, and is provided with first and second air spout holes 10, 11. The shaping air ring 32 forms part of the earth member according to the present invention. Therefore, the shaping air ring 32 is formed in a cylindrical shape using, for example, a conductive metallic material, and is connected to ground through the air motor 3.

An annular flange part 32B is formed on an outer peripheral surface 32A of the shaping air ring 32 to project radially outside. The flange part 32B is arranged in a position opposed to the midway part between a rear end part 33B and a front end part 33C of the semi conductive member 33 to be described later. That is, the flange part 32B forms an inside engaging part engaging with an engaging projection 33A. It should be noted that for preventing discharge between the front end part 19D of the front cover 19 and the flange part 32B, for example, the flange part 32B is preferably arranged in a position closer to a stepped part 32C than the front end part 19D.

Indicated at 33 is the semi conductive member according to the second embodiment that is formed by a semi conductive material. The semi conductive member 33 is formed as substantially similar to the semi conductive member 21 according to the first embodiment. Therefore, the semi conductive member 33 flares from forward to backward to be formed in a substantially conical shape or substantially cylindrical shape.

A plurality (for example, five) of engaging projections 33A are formed in the intermediate position of the semi conductive member 33 in the front-rear direction of the semi conductive member 33 to project radially inside. The plurality of engaging projections 33A form an outside engaging part engaging with the flange part 32B of the shaping air ring 32. Specifically, the plurality of engaging projections 33A extend in an arc shape along the flange part 32B of the shaping air ring 32 toward the circumferential direction, and are arranged to be spaced by equal intervals from each other in the circumferential direction.

A rear end part 33B that is one end part of the semi conductive member 33 is in contact with the front end part 19D of the front cover 19. Specifically, the rear end part 33B of the semi conductive member 33 covers the front end part 19D of the front cover 19 from outside to be in surface contact with the front end part 19D of the front cover 19, and the semi conductive member 33 can be electrically conductive to the front cover 19.

On the other hand, a front end part 33C that is the other end part of the semi conductive member 33 is in contact with the shaping air ring 32. Specifically, the front end part 33C of the semi conductive member 33 is formed as a ring-shaped flat plate extending radially inside, is in surface contact with an end surface of the stepped part 32C provided on a front outer peripheral side of the shaping air ring 32, and the semi conductive member 33 can be electrically conductive to the shaping air ring 32.

When the semi conductive member 33 is pushed against the shaping air ring 32 from forward to backward, the plurality of engaging projections 33A run over the flange part 32B to be locked on a rear surface of the flange part 32B. At this time, the front end part 33C of the semi conductive member 33 is in surface contact with the end surface of the stepped part 32C of the shaping air ring 32. Therefore, the flange part 32B and the stepped part 32C of the shaping air ring 32 are interposed in the front-rear direction between the engaging projection 33A and the front end part 33C of the semi conductive member 33. As a result, the semi conductive member 33 is mounted to the outer peripheral side of the shaping air ring 32.

On the other hand, when the semi conductive member 33 is pulled forward, the engaging projection 33A is flexibly deformed and the engaging projection 33A is pulled out of the flange part 32B. Thereby, the semi conductive member 33 can be removed from the shaping air ring 32.

Thus, also in the second embodiment as configured above, operational effects substantially similar to those in the first embodiment can be obtained. Particularly, in the second embodiment, since the flange part 32B is provided in the shaping air ring 32 and the engaging projection 33A is provided in the semi conductive member 33, the semi conductive member 33 can be replaceably mounted to the shaping air ring 32 in a state where the engaging projection 33A is engaged with the flange part 32B. Therefore, only the semi conductive member 33 that tends to be easily contaminated can be replaced. In addition, the adaptor 16 can be eliminated in contrast to the first embodiment, making it possible to reduce manufacturing costs.

Next, FIG. 9 to FIG. 14 show a third embodiment of an electrostatic coating apparatus according to the present invention. The third embodiment is characterized in that a front cover of a film cover is formed with a semi conductive material to be connected to a shaping air ring, and a rear cover of the film cover is provided with two separating parts that are separated by a cutting part. In the third embodiment, the component elements that are identical to those of the foregoing first embodiment will be simply denoted by the same reference numerals to avoid repetitions of similar explanations.

Designated at 41 is a rotary atomizing head type coating apparatus (hereinafter, referred to as coating apparatus 41) according to the third embodiment. The coating apparatus 41 includes, as substantially similar to the coating apparatus 1 according to the first embodiment, an atomizer 2, a housing member 6, a shaping air ring 43, external electrode units 13, a high voltage generator 15, a front cover 44, a semi conductive member 21 and the like.

However, a mounting base 42 is provided on a rear end part of the housing member 6 to be positioned closer to the rear side than the support member 14. The mounting base 42 is bent from an axis line of the housing member 6 to extend downward. Here, the housing member 6 is mounted to an arm (not shown) of a robot, reciprocator or the like through the mounting base 42 and moves integrally with the arm.

Figure 11:
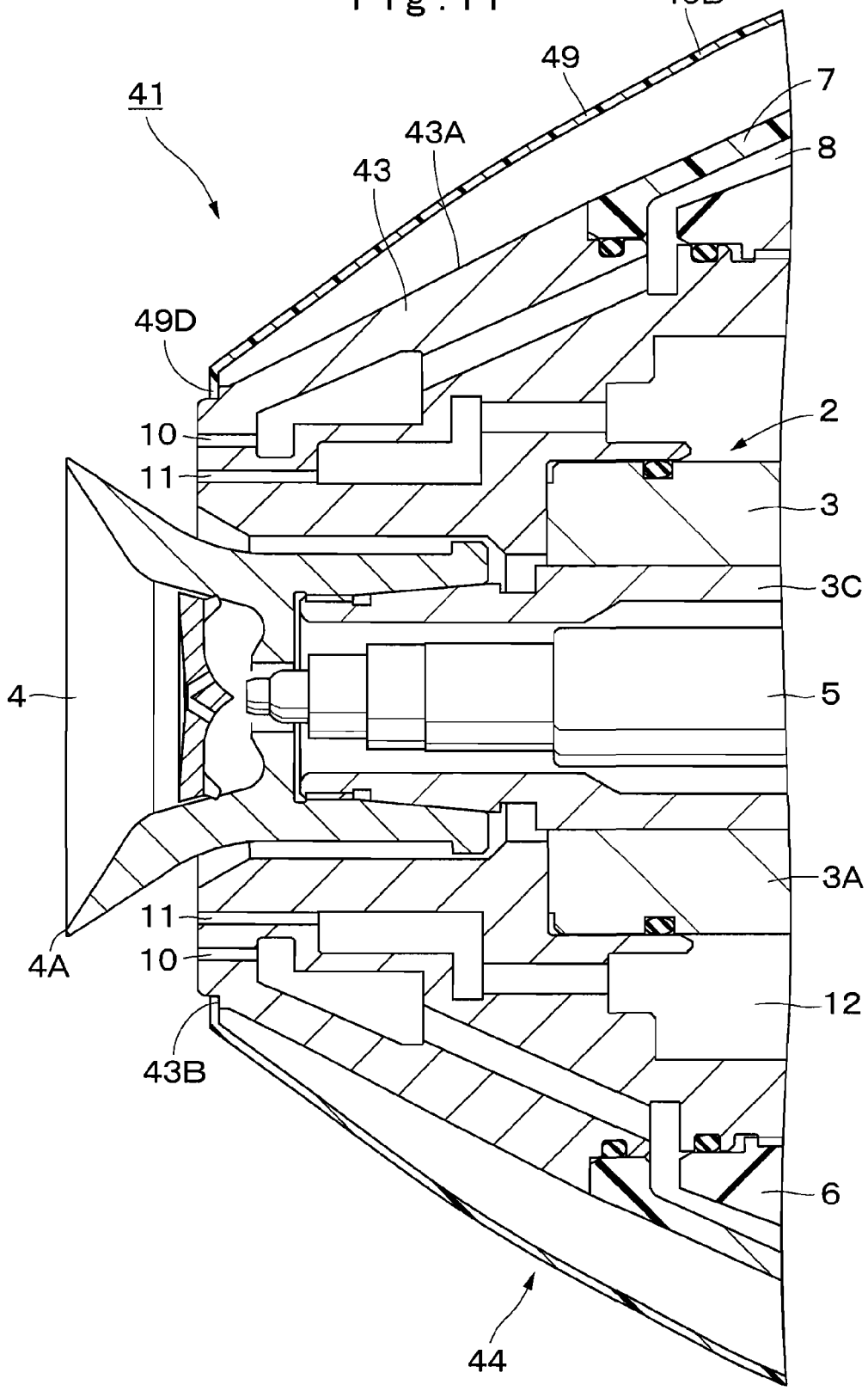
FIG. 11 is a partially enlarged cross section showing the periphery of a rotary atomizing head, a shaping air ring and a front cover in a position similar to that of FIG. 4.

Designated at 43 is the shaping air ring according to the third embodiment. As shown in FIG. 11, the shaping air ring 43 is configured as substantially similar to the shaping air ring 9 according to the first embodiment, and is provided with first and second air spout holes 10, 11. The shaping air ring 43 forms part of the earth member according to the present invention. Therefore, the shaping air ring 43 is formed in a cylindrical shape using, for example, a conductive metallic material, and is connected to ground through the air motor 3. Further, the shaping air ring 43 has an outer peripheral surface 43A, and a stepped part 43B is formed on a front end part of the shaping air ring 43 by protruding a radial inside part of the shaping air ring 43 forward.

Figure 9:
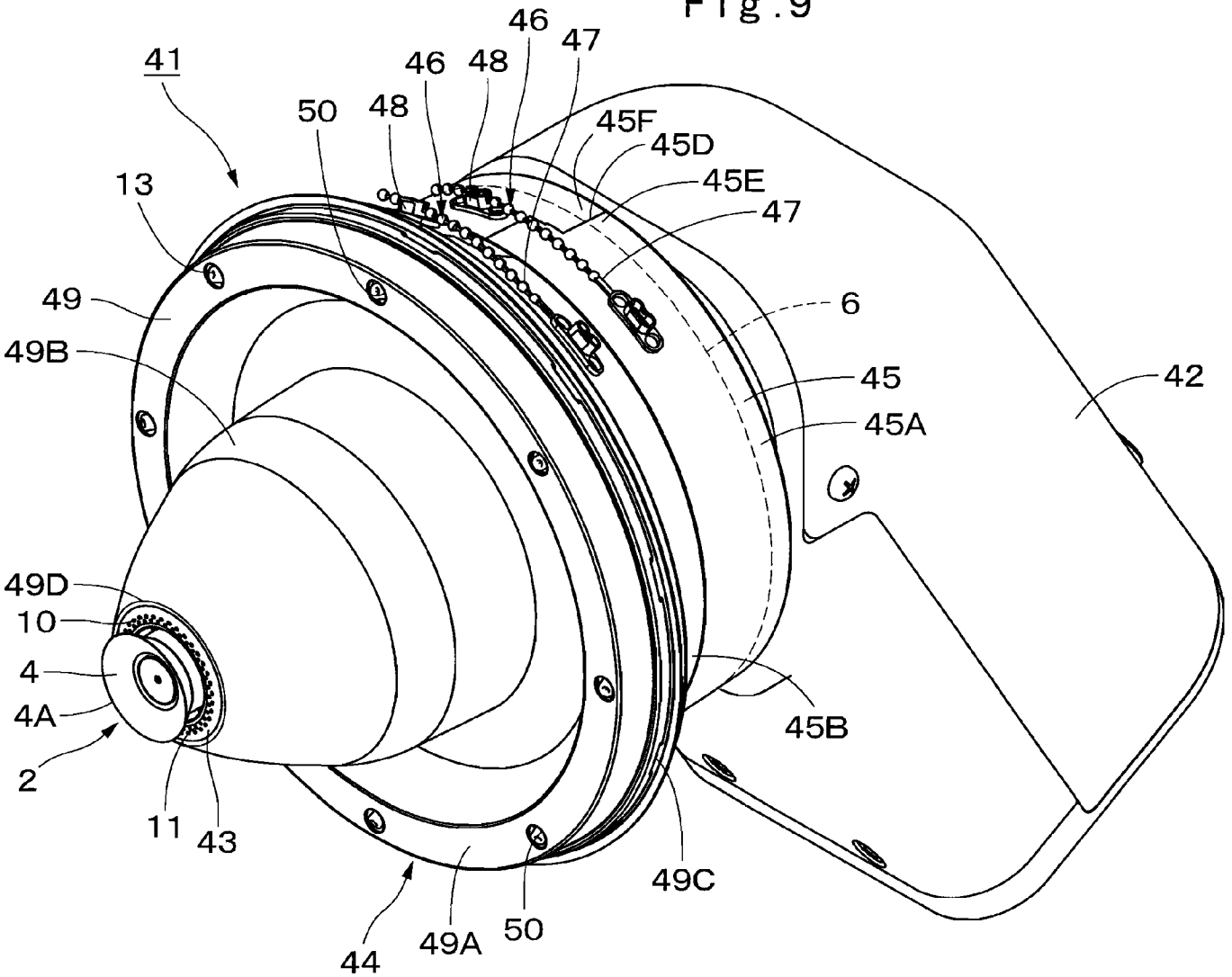
FIG. 9 is a perspective view showing a rotary atomizing head type coating apparatus according to a third embodiment.
Figure 10:
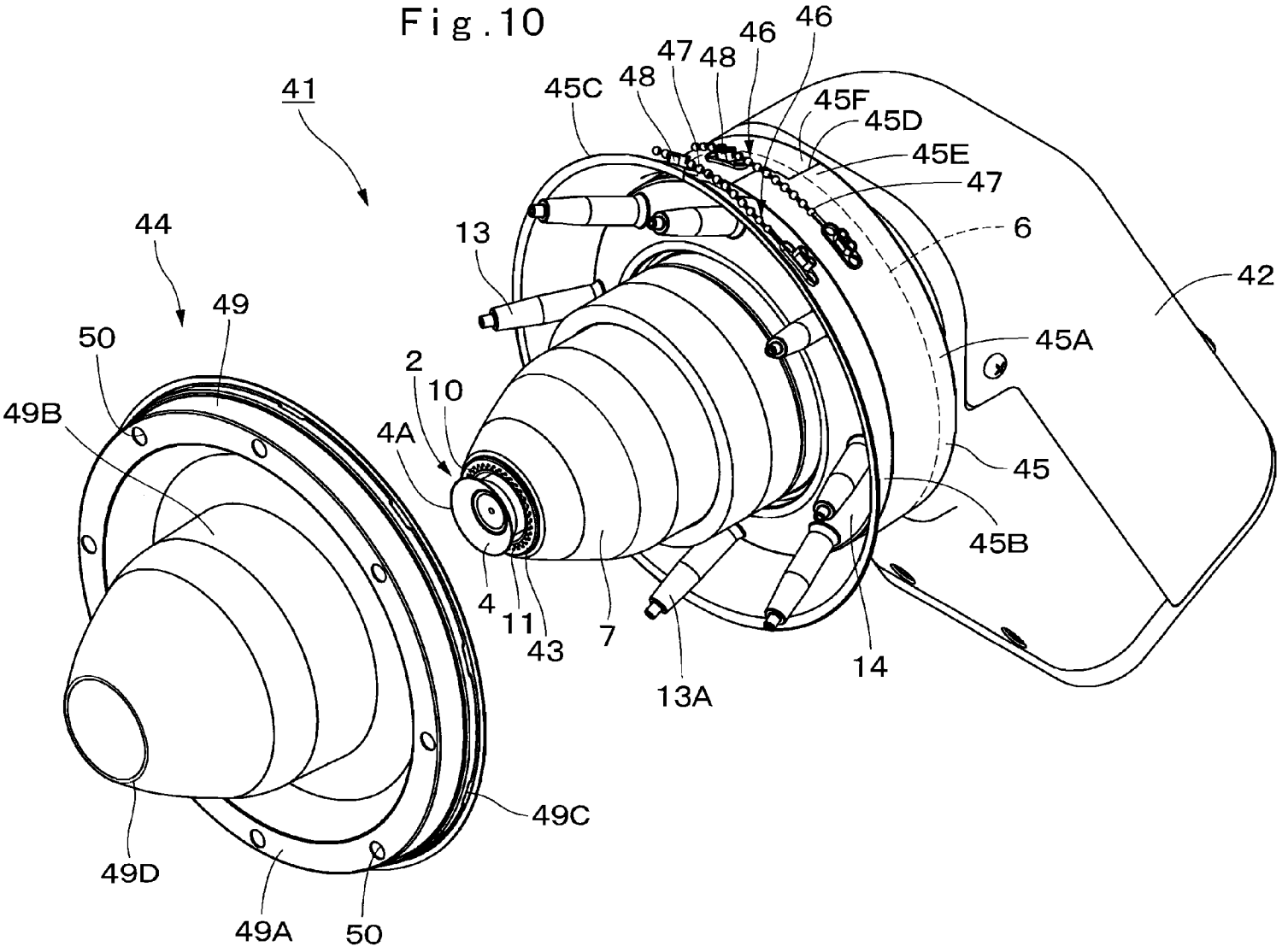
FIG. 10 is an exploded perspective view showing the rotary atomizing head type coating apparatus in FIG. 9 in a state where a front cover and a rear cover are exploded.

Designated at 44 is a film cover that is used in the third embodiment. The film cover 44 is formed with a rear cover 45 and a front cover 49 as substantially similar to the film cover 17 according to the first embodiment. That is, as shown in FIG. 9 and FIG. 10, the film cover 44 includes the cylindrical rear cover 45 that is mounted to the housing member 6 to cover the rear side from the external electrode unit 13 and the cylindrical front cover 49 that is mounted to the front side of the rear cover 45 to cover the front side from the external electrode unit 13.

The rear cover 45 is formed as substantially similar to the rear cover 18 according to the first embodiment and is formed in a cylindrical shape to surround the housing member 6. The rear cover 45 is provided with a fixing part 45A that is formed in a cylindrical shape to be fixed to the housing member 6 and a flared part 45B that extends forward from a front end of the fixing part 45A to flare in a bell shape. The flared part 45B covers an outer peripheral side of the external electrode units 13, and eight electrode support arms 13A are arranged in the inside thereof. On the other hand, a flange part 45C as a rear combining part widening radially outside is provided in a front side opening end of the flared part 45B. The flange part 45C of the rear cover 45 is inserted in a combining groove part 49C of the front cover 49. Therefore, the front cover 49 is attached to the front side of the rear cover 45.

Figure 12:
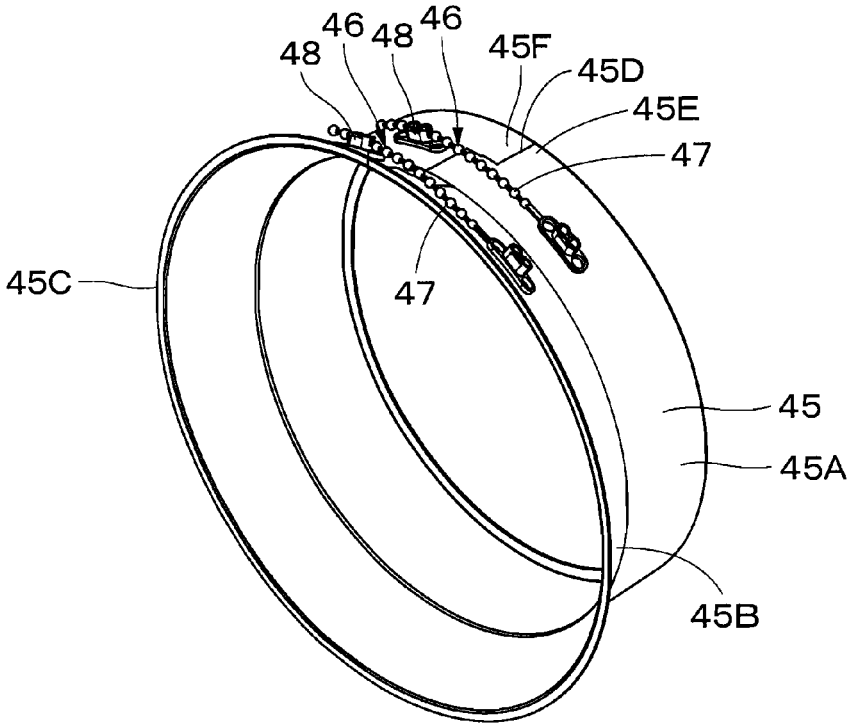
FIG. 12 is a perspective view showing the rear cover in FIG. 9 as a single unit.
Figure 13:
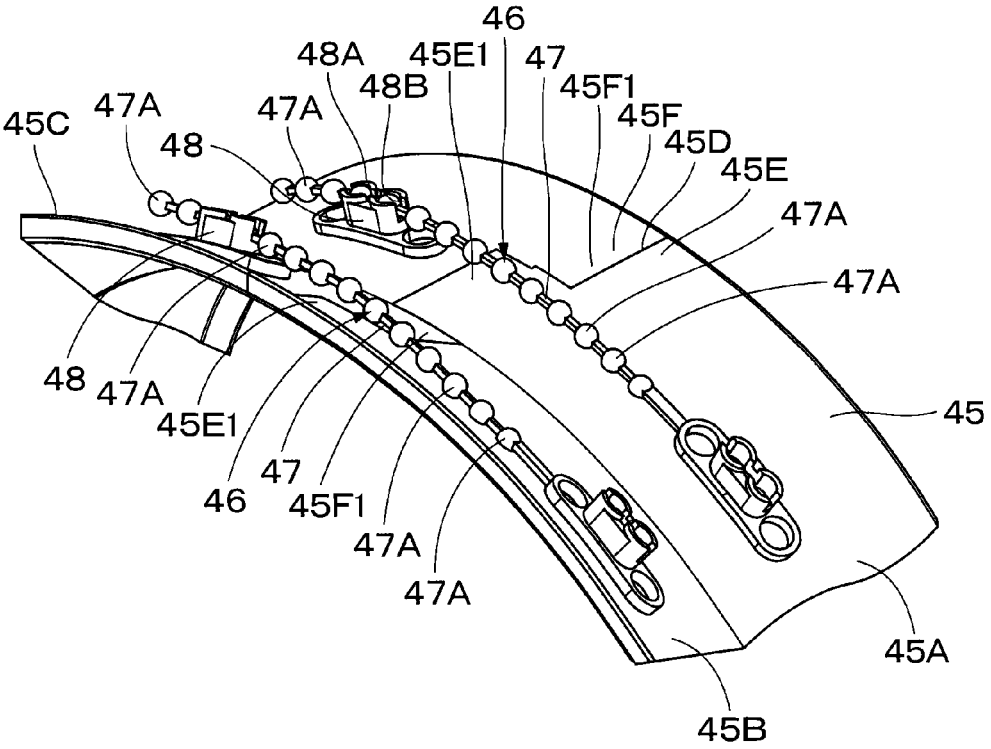
FIG. 13 is a partially enlarged perspective view shown by enlarging binders in FIG. 12.
Figure 14:
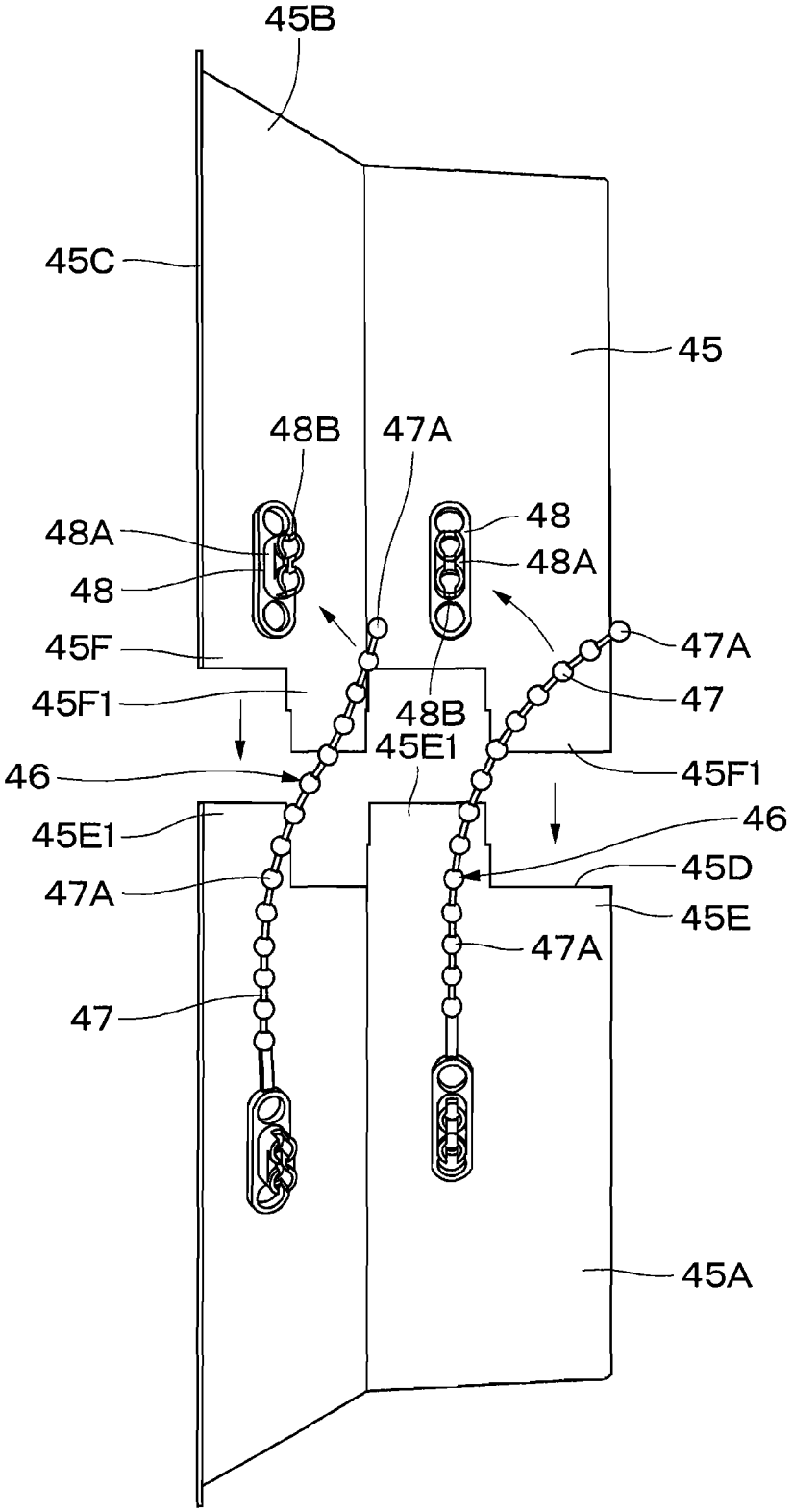
FIG. 14 is a side view showing the rear cover in FIG. 12 in a state where a cutting part is opened.

As shown in FIG. 12 to FIG. 14, the rear cover 45 is provided with a cutting part 45D that axially cuts the rear cover 45 and two separating parts 45E, 45F separated by the cutting part 45D. The separating parts 45E, 45F are respectively provided with projected pieces 45E1, 45F1 alternately projecting to each other. When the rear cover 45 is mounted to the housing member 6, the projected pieces 45E1, 45F1 are fitted to each other. Therefore, the projected pieces 45E1, 45F1 suppress the separating parts 45E, 45F from being position-shifted in the front-rear direction.

The separating parts 45E, 45F are provided with two binders 46 as coupling members that are spaced from each other. One of the binders 46 is provided, for example, in a position of the fixing part 45A of the rear cover 45 and the other of the binders 46 is provided in a position of the flared part 45B. Each of the binders 46 includes a binding wire 47 a base end part of which is fixed to the separating part 45E and a receiver 48 fixed to the separating part 45F of the opponent.

The binding wire 47 is formed in a string shape by using a resin material having flexibility, for example and a front end part thereof is configured as a free end. Further, the binding wire 47 is provided with a plurality of knot parts 47A arranged along a length direction.

On the other hand, the receiver 48 is provided with a substantially cylindrical engaging projection 48A an upper side of which is opened and a notched part 48B formed by notching a part of the engaging projection 48A in the opening side. At the time of coupling the separating parts 45E, 45F to each other, any one of the knot parts 47A in the binding wire 47 is inserted in the engaging projection 48A. At the time of releasing the coupling of the separating parts 45E, 45F, the knot part 47A of the binding wire 47 is pulled out of the engaging projection 48A. Thereby, the two separating parts 45E, 45F are removably coupled by the binder 46.

As shown in FIG. 9 to FIG. 11, designated at 49 is the front cover of the film cover 44. The front cover 49 is formed, for example, using a semi conductive material as similar to that of the semi conductive member 21 according to the first embodiment. Except for this material, the front cover 49 is formed as substantially similar to the front cover 19 according to the first embodiment. Therefore, the front cover 49 includes a disc part 49A formed in a disc shape to be positioned in a rear part outer peripheral side and a cylindrical part 49B that is formed to be connected to an inner peripheral edge of the disc part 49A in series and extends forward. The disc part 49A is provided with electrode openings 50 formed in positions corresponding to front end parts of the external electrode units 13. The needle electrode member 13B of the external electrode unit 13 is exposed to the front side from the electrode opening 50.

As shown in FIG. 11, the cylindrical part 49B covers an outer peripheral side of the air motor 3 including the housing member 6 and the air passage member 7. A ring-shaped front end part 49D extending to a radial inside is provided in a front end position of the cylindrical part 49B, and the front end part 49D is in surface contact with an end surface of the stepped part 43B of the shaping air ring 43 and is electrically conductive thereto.

The combining groove part 49C as a front combining part that is positioned in the inner peripheral side to extend over the entire periphery is formed on a rear side opening end of the disc part 49A. At the time of pressing the front cover 49 against the rear cover 45 from the front side, the flange part 45C is inserted in the combining groove part 49C. Thereby, the front cover 49 is attached to the front side of the rear cover 45. Thus, the front cover 49 and the rear cover 45 are attached to be positioned closer to a radial outside than the external electrode unit 13. Therefore, in a state where the front cover 49 is attached to the rear cover 45, the external electrode units 13 can be accommodated to be interposed between the disc part 49A and the flared part 45B. On the other hand, when the front cover 49 is pulled forward, since the flange part 45C is flexibly deformed, the flange part 45C can be pulled out of the combining groove part 49C. Thereby, the front cover 49 can be removed from the outer peripheral side of the housing member 6.

Thus, also in the third embodiment as configured above, operational effects substantially similar to those in the aforementioned first embodiment can be obtained. Particularly, in the third embodiment, the front cover 49 of the film cover 44 is formed by the semi conductive material, and the front end part 49D is connected electrically to the stepped part 43B of the shaping air ring 43.

Accordingly, since the front cover 49 is charged with same polarity as that of the charged paint particles as substantially similar to the semi conductive member 21 according to the first embodiment, the charged paint particle is more difficult to adhere thereto as compared to the shaping air ring 43, making it possible to suppress the contamination.

Further, when the front cover 49 takes charge, there is a possibility that discharge is generated between the charged front cover 49 and the grounded shaping air ring 43. At this time, since the front cover 49 is formed by the semi conductive material, even if the electrical current by discharge flows in the front cover 49, the electrical current does not become intensive large electrical current for a short time, but slow electrical current. As a result, degradation of the front cover 49 can be suppressed to enhance the durability.

On the other hand, in the third embodiment, the cylindrical rear cover 45 is provided with the two separating parts 45E, 45F that are separated by the cutting part 45D. Therefore, the rear cover 45 can be easily mounted to the housing member 6 from the lateral side (for example, upper-lower direction or left-right direction) by coupling the two separating parts 45E, 45F to each other by using the binder 46. Thereby, for example, even in a state where the housing member 6 is mounted to a robot or the like through the mounting base 42, the rear cover 45 can be easily mounted to the housing member 6.

Since the two separating parts 45E, 45F are coupled by the binder 46, the separating parts 45E, 45F pull away from each other by releasing the coupling by the binder 46, thus making it possible to remove the rear cover 45 from the housing member 6. On the other hand, the rear cover 45 is fixed to the housing member 6 by coupling the two separating parts 45E, 45F with the binder 46. Therefore, the rear cover 45 can be easily replaced to enhance the maintenance properties.

Figure 15:
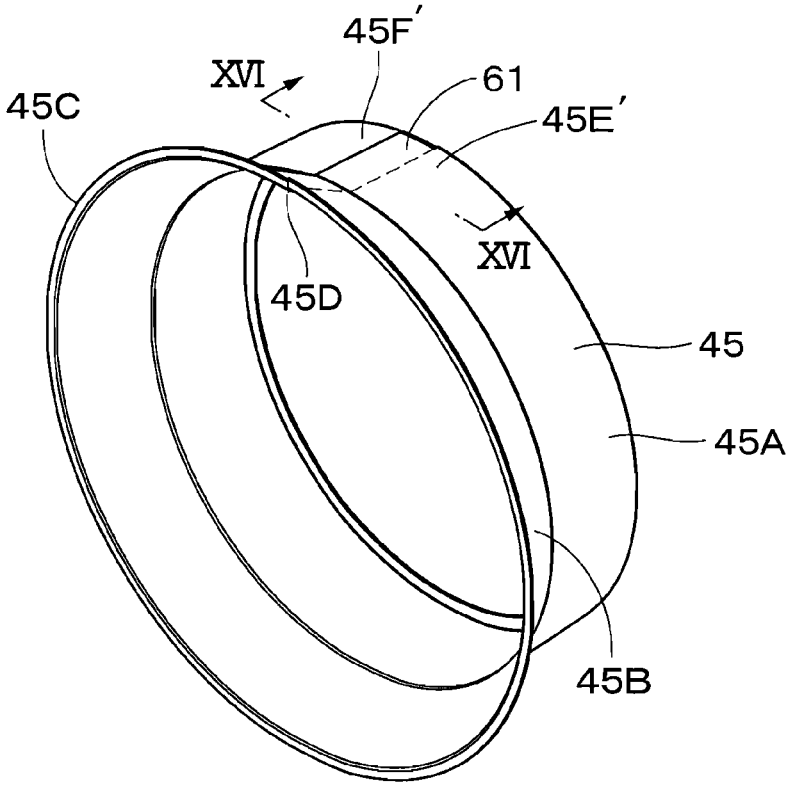
FIG. 15 is a perspective view showing a rear cover according to a first modification as a single unit.
Figure 16:
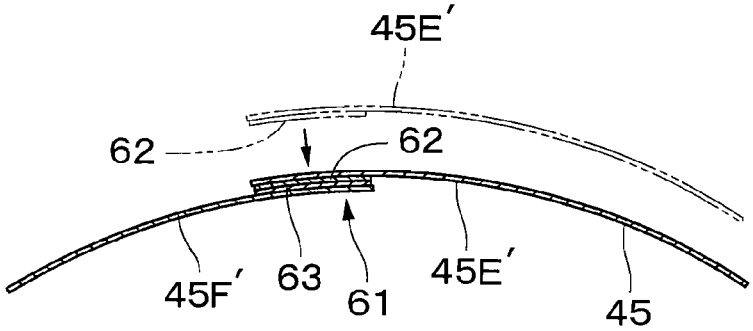
FIG. 16 is a cross section showing a surface fastener of the rear cover as viewed to be enlarged in a direction of arrows XVI-XVI in FIG. 15.

Moreover, in the third embodiment, it should be noted that the two separating parts 45E, 45F of the rear cover 45 are removably coupled using the binder 46 composed of the binding wire 47 and the receiver 48. However, the present invention is not limited thereto, and, for example, as in a case of a first modification as shown in FIG. 15 and FIG. 16, a surface fastener 61 as a coupling member may be used to removably couple two separating parts 45E', 45F'.

In a case of the first modification, the separating parts 45E', 45F' have such a length dimension as to be able to overlap. A hook part 62 of the surface fastener 61 is mounted to an inner peripheral surface of the separating part 45E', and a loop part 63 of the surface fastener 61 is mounted to an outer peripheral surface of the separating part 45F'. Thereby, the separating parts 45E', 45F' are coupled to each other by engagement of the hook part 62 and the loop part 63. In such a coupled state, the surface fastener 61 can suppress positional shifts in the front-rear direction as well as in the circumferential direction of the housing member 6. Therefore, it is not necessary to provide a projecting piece for suppressing the positional shift in the front-rear direction on the separating parts 45E', 45F'.

Figure 17:
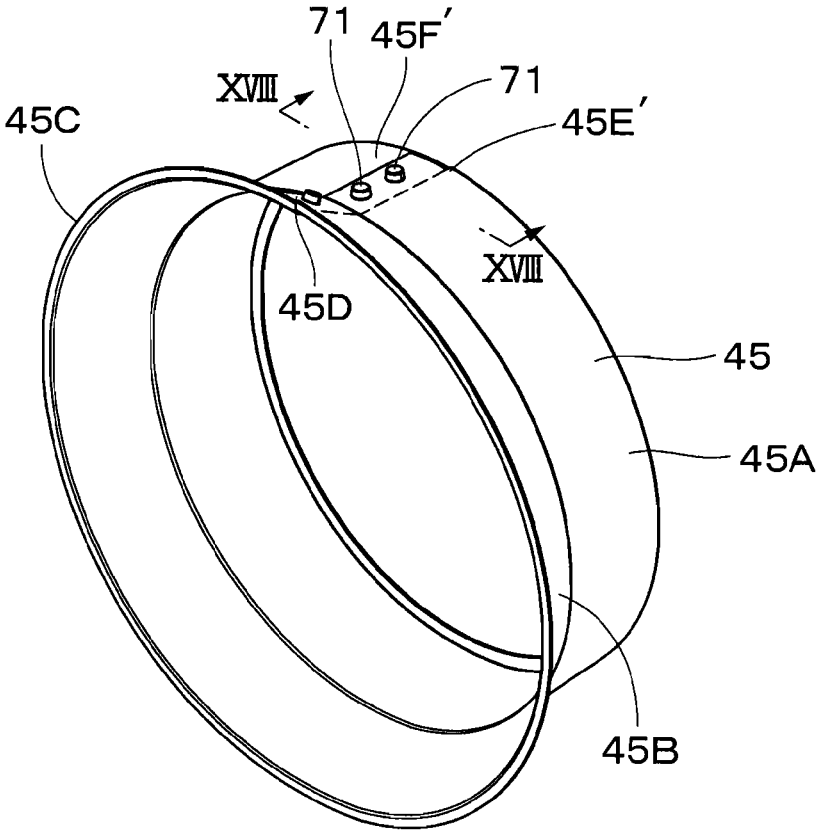
FIG. 17 is a perspective view showing a rear cover according to a second modification as a single unit.
Figure 18:
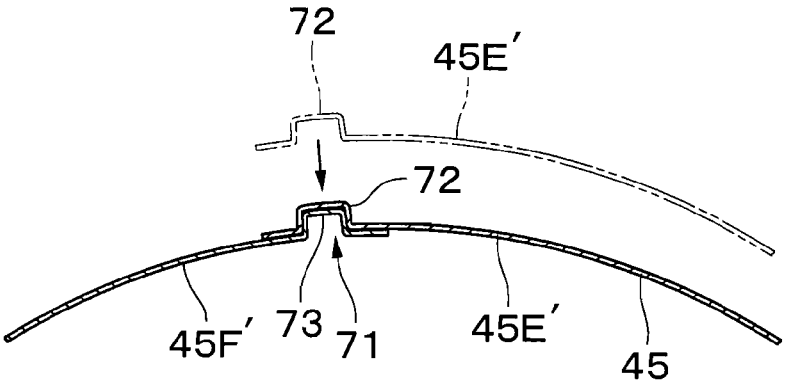
FIG. 18 is a cross section showing a hook of the rear cover as viewed to be enlarged in a direction of arrows XVIII-XVIII in FIG. 17.

Further, as in a case of a second modification as shown in FIG. 17 and FIG. 18, the two separating parts 45E', 45F' may be removably coupled by using hooks 71 as coupling members. In this case also, the two separating parts 45E', 45F' each have such a length dimension as to be able to overlap. An outer side recess 72 of the hook 71 is mounted to the separating part 45E', and an inner side projection 73 of the hook 71 is mounted to the separating part 45F'. As a result, the separating parts 45E', 45F' are coupled to each other by inserting the inner side projection 73 in the outer side recess 72.

In the third embodiment, the two separating parts 45E, 45F of the rear cover 45 are removably coupled. However, the present invention is not limited thereto, and, for example, the rear cover 45 may be mounted to the housing member 6 by fixation of the separating parts 45E, 45F through adhesion or thermal compression bond. In this case, at the time of replacing the rear cover 45, for example, the cutting part 45D is cut to remove the rear cover 45, and a new rear cover 45 may be mounted to the housing member 6.

Further, in the third embodiment, the cutting part 45D is provided at one location to the rear cover 45, but cutting parts may be provided at a plurality of locations in different positions in the circumferential direction.

On the other hand, in the respective aforementioned embodiments, a case where five engaging projections 21A of the semi conductive member 21 and five engaging projections 33A of the semi conductive member 33 are respectively provided to be spaced in the circumferential direction is explained as an example, but two, three, four, six or more engaging projections may be provided. Further, for example, one engaging projection may be formed over an entire circumference to project in an annular shape or in a C-letter shape.

It should be noted that the first embodiment illustrates a case where the flange part 18C as the rear combining part spreading in the radial outside is provided on the front side opening end of the rear cover 18, and the combining groove part 19C as the front combining part is provided on the rear side opening end of the disc part 19A of the front cover 19 to be positioned on the inner peripheral side and to be fitted in the flange part 18C by insert thereof. However, the present invention is not limited thereto, and, for example, a flange part may be provided on the rear side opening end of the front cover 19 and a combining groove part may be provided on the front side opening end of the rear cover 18 to be fitted in the flange part by insert thereof. Besides, any component that can integrally mount the rear cover 18 and the front cover 19, such as screwing, convex/concave fixation of plural locations, adhesion or bonding, may be used as an attachment component. This configuration can be applied also to the second and third embodiments.

In the first embodiment, the semi conductive member 21 is replaceably mounted to the adaptor 16 provided in the shaping air ring 9. However, the present invention is not limited thereto, and, for example, the semi conductive member may be formed by integration of the semi conductive member 21 and the adaptor 16. In this case, the semi conductive member may be replaceably mounted to the shaping air ring.

In the first embodiment, the rear end part 21B of the semi conductive member 21 is made in contact with the film cover 17 and the front end part 21C is made in contact with the shaping air ring 9. However, the semi conductive member may be formed as an annular plate body extending radially, wherein a radial outside end part thereof is made in contact with a film cover and a radial inside end part thereof is made in contact with a shaping air ring. Besides, when the film cover and the earth member are electrically connected using the semi conductive member, positions of one end part and the other end part of the semi conductive member can be set as needed. This configuration can be applied to the second and third embodiments.

In the first embodiment, the semi conductive member 21 is in contact with the film cover 17 in a separable state, but, for example, the semi conductive member may be connected or adhere to the film cover in an inseparable state or may be formed integrally. In this case, a contact failure between the semi conductive member and the film cover can be prevented. This configuration can be applied to the second embodiment.

The first embodiment is explained by taking a case where the shaping air ring 9 forms the earth member, as an example. However, the present invention is not limited thereto, and, for example, the earth member may be provided separately from the shaping air ring, wherein the semi conductive member is connected to ground through the earth member. This configuration can be applied to also to the semi conductive member in the second embodiment and the front cover in the third embodiment.

In each of the aforementioned embodiments, a case where the needle electrode member 13B is arranged on the rear side of the atomizer 2 is illustrated, however, it may be arranged on the front side of the atomizer 2. For accelerating supply of ions to the paint particle, the needle electrode member 13B is preferably arranged on the front side of the atomizer 2. On the other hand, for downsizing the coating apparatus 1, 31 or 41, the needle electrode member 13B is preferably arranged on the rear side of the atomizer 2.

In each of the aforementioned embodiments, a case where the electrode support arm 13A made of the long bar-shaped body of the external electrode unit 13 is provided in the collar-shaped support member 14 arranged on the rear side of the housing member 6 is illustrated. However, the present invention is not limited thereto, and there may be adopted the configuration that the support member 14 is formed as a cylindrical support member extending to the air passage member 7 or the rotary atomizing head 4 and a short electrode support arm is provided in a front end of this cylindrical support member.

In each of the aforementioned embodiments, the rotary atomizing head 4 is formed at its entity by the conductive material. However, the present invention is not limited thereto, and there may be adopted the configuration that, the body part having the substantially same shape as the rotary atomizing head 4 is formed using an insulating material, and a conductive or semi conductive coated layer is provided on an outside surface and an inside surface of the body part. In this case, a paint release edge of the rotary atomizing head is connected to ground through the coated layer.

In each of the aforementioned embodiments, the external electrode unit 13 is formed using the needle electrode member 13B. However, the present invention is not limited thereto, and an external electrode member may be formed using a ring electrode that surrounds an outer peripheral side of a cylindrical part of a front cover and is annularly formed with an elongated conductive wire. Besides, an external electrode unit may be formed using a blade ring in a thin blade shape, a star-shaped ring formed in a star shape with an elongated conductive wire, a spiral ring formed spirally with an elongated conductive wire or the like, which are described in Patent Document 1.

In each of the aforementioned embodiments, the housing member 6 and the air passage member 7 are separately provided, but the housing member and the air passage member may be formed integrally using an insulating material.

In each of the aforementioned embodiments, the motor is explained by taking the air motor as an example, but, for example, an electric motor may be used.

Further, in each of the aforementioned embodiments, the first and second air spout holes 10, 11 that spout the shaping air are arranged in a double-annular shape in each of the shaping air rings 9, 32, 43. However, the present invention is not limited thereto, and, for example, the air spout hole may be arranged in a single annular shape by eliminating any one of the first and second air spout holes, for example.

DESCRIPTION OF REFERENCE NUMERALS

1, 31, 41: Rotary atomizing head type coating apparatus (Coating apparatus)
3: Air motor (motor)
3C: Rotary shaft
4: Rotary atomizing head
4A: Paint release edge
6: Housing member
9, 32, 43: Shaping air ring (Earth member)
10: First air spout hole
11: Second air spout hole
13: External electrode unit
13A: Electrode support arm
13B: Needle electrode member
15: High-voltage generator (High-voltage applying unit)
16: Adaptor
17, 44: Film cover
18, 45: Rear cover
18A, 45A: Fixing part
18B, 45B: Flared part
18C, 45C: Flange part (Rear combining part)
19, 49: Front cover
19A, 49A: Disc part

19B, 49B: Cylindrical part
19C, 49C: Combining groove part (Front combining part)
19D, 49D: Front end part
20, 50: Electrode opening
21, 33: Semi conductive member
21A, 33A: Engaging projection
21B, 33B: Rear end part
21C, 33C: Front end part
32B: Collar part
45D: Cutting part
45E, 45F, 45E', 45F': Separating part
46: Binder (Coupling member)
61: Surface fastener (Coupling member)
71: Hook (Coupling member)

The invention claimed is:

1. An electrostatic coating apparatus comprising:
a motor;
a rotary atomizing head that is provided on a front side of said motor to be rotatable by said motor;
an external electrode unit that is provided in a periphery of said rotary atomizing head; and
a high-voltage applying unit that applies a high voltage to said external electrode unit to indirectly charge paint particles atomized from said rotary atomizing head with the high voltage;
wherein a film cover is provided to be formed with a resin material in a film shape for covering an outer peripheral side of said motor;
wherein said film cover includes a cylindrical rear cover that covers a rear side from said external electrode unit and a cylindrical front cover that is mounted to a front side of said cylindrical rear cover to cover the front side from said external electrode unit;
wherein a flange part as a rear combining part that spreads radially outward is provided on the front side opening end of said cylindrical rear cover, and
an annular combining groove part as a front combining part is provided on a rear side opening end of said cylindrical front cover, the annular combining groove part is positioned on an inner peripheral side of the cylindrical front cover and extends over an entire circumference of the cylindrical front cover, and
wherein said film cover is formed to be integrated by inserting said flange part of said cylindrical rear cover in said annular combining groove part of said cylindrical front cover.

2. The electrostatic coating apparatus according to claim 1, wherein
said cylindrical front cover is mounted to said cylindrical rear cover in a state a front end part of said external electrode unit is exposed.

3. The electrostatic coating apparatus according to claim 1, wherein
said external electrode unit includes an electrode support arm, and a needle electrode member that is provided in said electrode support arm and to which a high voltage is applied from said high-voltage applying unit,
said film cover covers said electrode support arm of said external electrode unit together with said motor, and
said needle electrode member of said external electrode unit is exposed from an electrode opening formed in said cylindrical front cover of said film cover.

4. The electrostatic coating apparatus according to claim 1, wherein
said motor is supported to a housing member,
said film cover covers said housing member and said external electrode unit.

5. The electrostatic coating apparatus according to claim 1, wherein
said cylindrical rear cover includes a cutting part in which said cylindrical rear cover is axially cut, and two separating parts that are separated by said cutting part.

6. The electrostatic coating apparatus according to claim 5, wherein
said two separating parts are removably coupled by a coupling member.

7. The electrostatic coating apparatus according to claim 1, further comprising:
a shaping air ring provided on the rear side of said rotary atomizing head, said shaping air ring including an air spout hole formed to spout shaping air and being connected to ground, and
said cylindrical front cover is formed by a semi conductive member and is connected to said shaping air ring.

8. An electrostatic coating apparatus comprising:
a motor;
a rotary atomizing head that is provided on a front side of said motor to be rotatable by said motor;
an external electrode unit that is provided in the periphery of said rotary atomizing head; and
a high-voltage applying unit that applies a high voltage to said external electrode unit to indirectly charge paint particles atomized from said rotary atomizing head with the high voltage:
wherein a film cover is provided to be formed with a resin material in a film shape for covering an outer peripheral side of said motor;
wherein said film cover includes a cylindrical rear cover that covers a rear side from said external electrode unit and a cylindrical front cover that is mounted to a front side of said cylindrical rear cover to cover the front side from said external electrode unit;
wherein an annular combining groove part as a rear combining part is provided on the front side opening end of said cylindrical rear cover, the annular combining groove part is positioned on an inner peripheral side of the cylindrical front cover and extends over an entire circumference of the cylindrical front cover,
wherein a flange part as a front combining part that spreads radially outward is provided on a rear side opening end of said cylindrical front cover, and
wherein said film cover is formed to be integrated by inserting said flange part of said cylindrical front cover in said combining groove part of said cylindrical rear cover.

* * * * *